US009786456B2

(12) United States Patent
Claggett et al.

(10) Patent No.: US 9,786,456 B2
(45) Date of Patent: Oct. 10, 2017

(54) FAIL-SAFE SYSTEM FOR PROCESS MACHINE

(71) Applicant: Ryan Patrick Claggett, Whitecourt (CA)

(72) Inventors: Ryan Patrick Claggett, Whitecourt (CA); Todd A Urness, Guelph (CA)

(73) Assignee: Ryan Patrick Claggett, Whitecourt, Alberta (CA)

( * ) Notice: Subject to any disclaimer, the term of this patent is extended or adjusted under 35 U.S.C. 154(b) by 238 days.

(21) Appl. No.: 14/548,910

(22) Filed: Nov. 20, 2014

(65) Prior Publication Data

US 2016/0148767 A1 May 26, 2016

(51) Int. Cl.

| | |
|---|---|
| ***H01H 35/00*** | (2006.01) |
| ***H01H 83/00*** | (2006.01) |
| ***H01H 47/00*** | (2006.01) |
| ***F04B 51/00*** | (2006.01) |
| ***F04B 49/06*** | (2006.01) |

(52) U.S. Cl.

CPC ..... *H01H 47/002* (2013.01); *F04B 49/06* (2013.01); *F04B 49/065* (2013.01); *F04B 51/00* (2013.01)

(58) Field of Classification Search

CPC H01H 9/54; H01H 9/00; H01H 47/00; H01H 47/002; H01H 13/023; H01H 19/00; H01H 1/00; H01H 2003/008; H01H 2231/012; H01H 2300/018; H01H 2300/03; H01H 2300/032; H01H 23/148; H01H 35/006

See application file for complete search history.

(56) References Cited

U.S. PATENT DOCUMENTS

| | | | | |
|---|---|---|---|---|
| 3,417,290 | A | 12/1968 | Craddock | |
| 4,406,597 | A | 9/1983 | Stanton | |
| 5,116,356 | A * | 5/1992 | Ohkubo | F02D 35/023 123/406.43 |
| 5,820,350 | A | 10/1998 | Mantey et al. | |
| 5,909,783 | A | 6/1999 | Berish | |
| 7,007,751 | B2 | 3/2006 | Eggleston | |
| 7,573,693 | B2 | 8/2009 | Hornung | |

(Continued)

FOREIGN PATENT DOCUMENTS

| | | |
|---|---|---|
| CA | 1194205 | 9/1985 |
| CA | 2116614 | 8/1995 |
| CA | 2808589 | 3/2012 |

*Primary Examiner* — Jared Fureman
*Assistant Examiner* — Esayas Yeshaw

(57) ABSTRACT

An apparatus is for a process machine having a process-status switch and a process-control element. The apparatus includes a sensor input signal conditioning circuit, a logic circuit and a power output circuit. The sensor input signal conditioning circuit is configured to provide a logic-converted status signal representing a process-status signal associated with the process-status switch of the process machine. The logic circuit is configured to provide a latched output signal converted from the logic-converted status signal provided by the sensor input signal conditioning circuit. The latched output signal has any one of a first latched state and a second latched state. The power output circuit is configured to execute any one of maintaining and disconnecting a voltage being applied to the process-control element depending on the state of the latched output signal.

20 Claims, 20 Drawing Sheets

(56) References Cited

U.S. PATENT DOCUMENTS

| | | | | |
|---|---|---|---|---|
| 7,760,117 | B1 * | 7/2010 | Chou | H03K 3/356121 327/51 |
| 8,362,642 | B2 * | 1/2013 | Zerbe | G06F 1/26 307/43 |
| 8,698,446 | B2 * | 4/2014 | Venkataraman | H02P 6/182 318/400.14 |
| 2004/0184206 | A1 * | 9/2004 | Nomura | H02H 7/0833 361/31 |
| 2006/0053314 | A1 * | 3/2006 | Hashidate | G06F 1/3203 713/300 |
| 2007/0075658 | A1 * | 4/2007 | Ishikawa | H02P 23/0004 318/85 |
| 2007/0207681 | A1 * | 9/2007 | Zabroda | G06K 9/00053 439/717 |
| 2009/0189664 | A1 * | 7/2009 | Remington | H03K 3/012 327/202 |
| 2010/0315067 | A1 * | 12/2010 | Cornelius | G01R 15/207 324/202 |
| 2013/0264890 | A1 | 10/2013 | Le et al. | |
| 2015/0255979 | A1 * | 9/2015 | Kaita | H02H 7/18 361/90 |
| 2016/0134265 | A1 * | 5/2016 | Liu | H03K 3/037 327/211 |

* cited by examiner

FAIL-SAFE SYSTEM FOR PROCESS MACHINE

TECHNICAL FIELD

Aspects generally relate to an apparatus (such as a fail-safe system) for a process machine (such as a pump jack), and a method associated with the apparatus.

BACKGROUND

A pump jack is an example of a process machine or a process system. The pump jack is an over ground drive for a reciprocating piston pump in an oil well. The pump jack is also called oil horse, donkey pumper, nodding donkey, pumping unit, horsehead pump, rocking horse, beam pump, dinosaur, sucker rod pump (SRP), grasshopper pump.

SUMMARY

A gas driven motor deployed on a pump jack (deployed in the oil and gas industry) sometime fails in the field (in situ). What is needed is a fail-safe system for the pump jack since there is a need to prevent oil spills on site or unknown disconnection of pump jack shut downs. There may be a requirement to allow the operator to view the status of the operating elements of the pump jack.

To mitigate, at least in part, at least one problem associated with existing fail-safe systems, there is provided (in accordance with a major aspect) an apparatus. The apparatus is for a process machine having a process-status switch and a process-control element. The apparatus includes a sensor input signal conditioning circuit, a logic circuit, and a power output circuit. The sensor input signal conditioning circuit is configured to provide a logic-converted status signal representing a process-status signal associated with the process-status switch of the process machine. The logic circuit is configured to provide a latched output signal converted from the logic-converted status signal provided by the sensor input signal conditioning circuit. The latched output signal has any one of a first latched state and a second latched state. The power output circuit is configured to execute any one of maintaining and disconnecting a voltage applied to the process-control element depending on the state of the latched output signal.

To mitigate, at least in part, at least one problem associated with existing fail-safe systems, there is provided (in accordance with a major aspect) a method. The method is for operating the apparatus for use with the process machine. The method includes providing a logic-converted status signal representing a process-status signal associated with the process-status switch of the process machine. The method also includes providing a latched output signal converted from the logic-converted status signal provided by the sensor input signal conditioning circuit (the latched output signal) having any one of a first latched state and a second latched state. The method also includes executing any one of maintaining and disconnecting a voltage applied to the process-control element depending on the state of the latched output signal.

Other aspects are identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
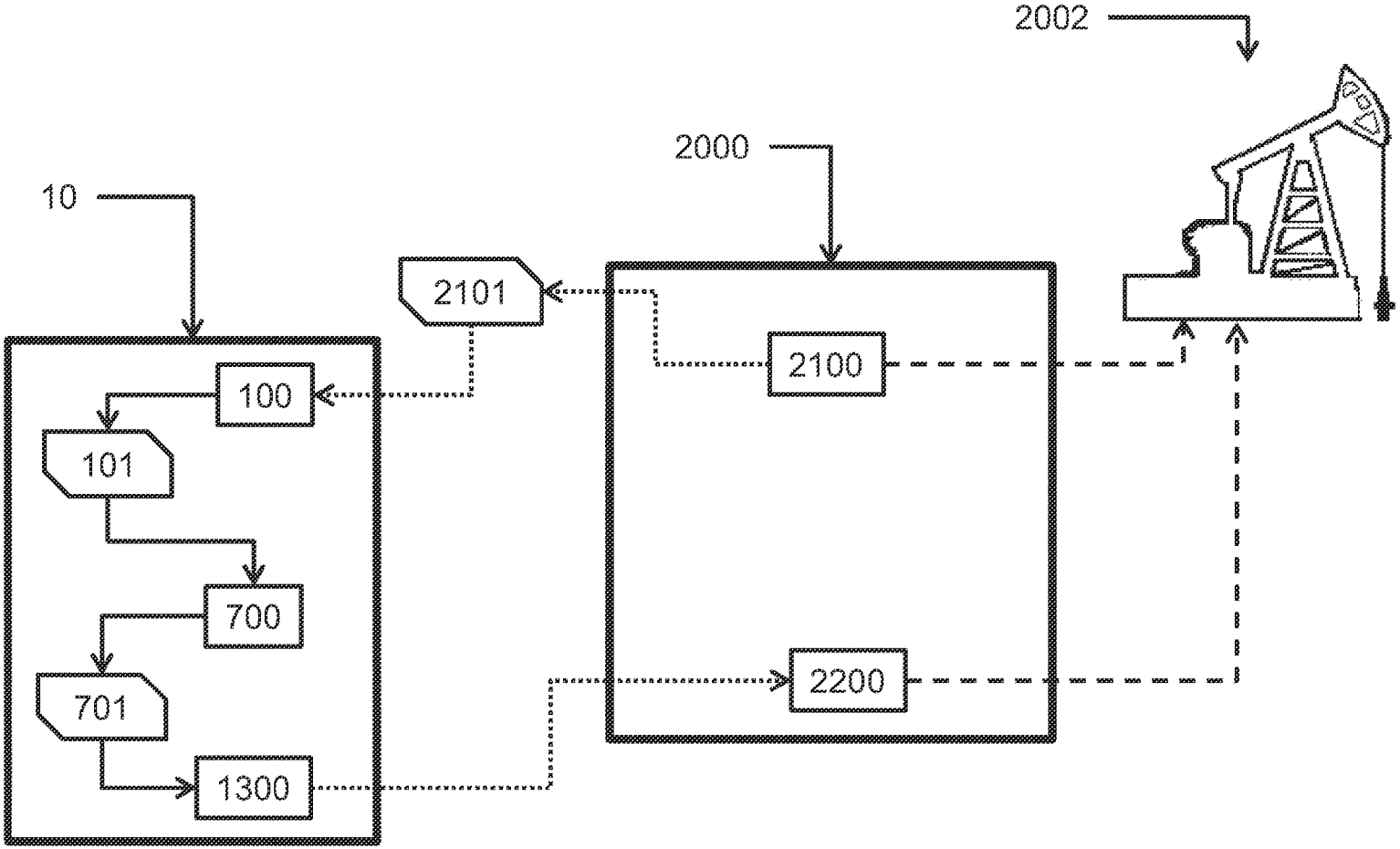
FIG. 1 (SHEET 1 OF 20 SHEETS) depicts a schematic view of a first embodiment of an apparatus (also called a fail-safe system) configured for use with a process machine.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

10 apparatus
100 sensor input signal conditioning circuit
101 logic-converted status signal
200 protection circuit
300 power supply circuit
400 latched status indicator circuit
500 sensor status indicator circuit
600 sensor input opto-isolation circuit
700 logic circuit
701 latched output signal
800 status indicator output circuit
900 status indicator test input circuit
1000 logic reset input circuit
1100 alarm output circuit
1200 relay contacts circuit
1300 power output circuit
1400 relay coil activation circuit
2000 process machine
2002 pump jack system
2100 process-status switch
2101 process-status signal
2200 process-control element
2300 state-monitoring circuit
2400 alarm-monitoring circuit
2500 visual-monitoring circuit

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the invention is defined by the claims. For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary, or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments, and any equivalent thereof) are described regarding the drawings. It should be understood that the invention is limited to the subject matter provided by the claims and that the invention is not limited to the particular aspects depicted and described.

FIG. 1 depicts a schematic view of a first embodiment of an apparatus 10 (also called a fail-safe system) configured for use with a process machine 2000 (such as a pump jack).

Referring to the embodiment depicted in FIG. 1, the apparatus 10 is also called a fail-safe system. The apparatus 10 is for a process machine 2000. The process machine 2000 has a process-status switch 2100 and a process-control element 2200. The apparatus 10 includes a sensor input signal conditioning circuit 100, a logic circuit 700 (also called a latch circuit), and a power output circuit 1300.

The sensor input signal conditioning circuit 100 is configured to provide a logic-converted status signal 101 representing a process-status signal 2101 associated with the process-status switch 2100 of the process machine 2000. The logic circuit 700 is configured to provide a latched output signal 701 converted from the logic-converted status signal 101 that is provided by the sensor input signal conditioning circuit 100. The latched output signal 701 has any one of a first latched state and a second latched state. The power output circuit 1300 is configured to execute any one of maintaining and disconnecting a voltage applied to the process-control element 2200 depending on the state of the latched output signal 701.

It will be appreciated that there is also provided a method of operating the apparatus 10 for use with the process machine 2000. The method includes providing a logic-converted status signal 101 representing a process-status signal 2101 associated with the process-status switch 2100 of the process machine 2000. The method also includes providing a latched output signal 701 converted from the logic-converted status signal 101 provided by the sensor input signal conditioning circuit 100 (the latched output signal 701 having any one of a first latched state and a second latched state. The method also includes executing any one of maintaining and disconnecting a voltage applied to the process-control element 2200 depending on the state of the latched output signal 701.

Referring to the embodiment depicted in FIG. 1, the apparatus 10 is adapted in such a way that the sensor input signal conditioning circuit 100 is further configured to receive the process-status signal 2101 associated with the process-status switch 2100 of the process machine 2000. The sensor input signal conditioning circuit 100 is further configured to convert the process-status signal 2101 associated with the process-status switch 2100 into the logic-converted status signal 101. The sensor input signal conditioning circuit 100 is further configured to provide the logic-converted status signal 101.

Referring to the embodiment depicted in FIG. 1, the apparatus 10 is further adapted in such a way that the logic circuit 700 is further configured to receive the logic-converted status signal 101 provided by the sensor input signal conditioning circuit 100. The logic circuit 700 is further configured to convert the logic-converted status signal 101 into the latched output signal 701. The latched output signal 701 has any one of the first latched state and the second latched state. The logic circuit 700 is further configured to provide the latched output signal 701. The logic circuit 700 is also called a digital logic circuit or an analog logic circuit.

Referring to the embodiment depicted in FIG. 1, the apparatus 10 is further adapted in such a way that the first latched state indicates the logic-converted status signal 101 provides an acceptable indication that the state of the process-status switch 2100 is acceptable.

Referring to the embodiment depicted in FIG. 1, the apparatus 10 is further adapted in such a way that the second latched state indicates the logic-converted status signal 101 provides an unacceptable indication that the state of the process-status switch 2100 is unacceptable.

Referring to the embodiment depicted in FIG. 1, the apparatus 10 is further adapted in such a way that the power output circuit 1300 is further configured to receive the latched output signal 701 provided by the logic circuit 700. The power output circuit 1300 is further configured to maintain the voltage applied to the process-control element 2200 for the case where the latched output signal 701 provided by the logic circuit 700 exists in the first latched state. The power output circuit 1300 is further configured to disconnect the voltage applied to the process-control element 2200 for the case where the latched output signal 701 provided by the logic circuit 700 exists in the second latched state.

Figure 2:
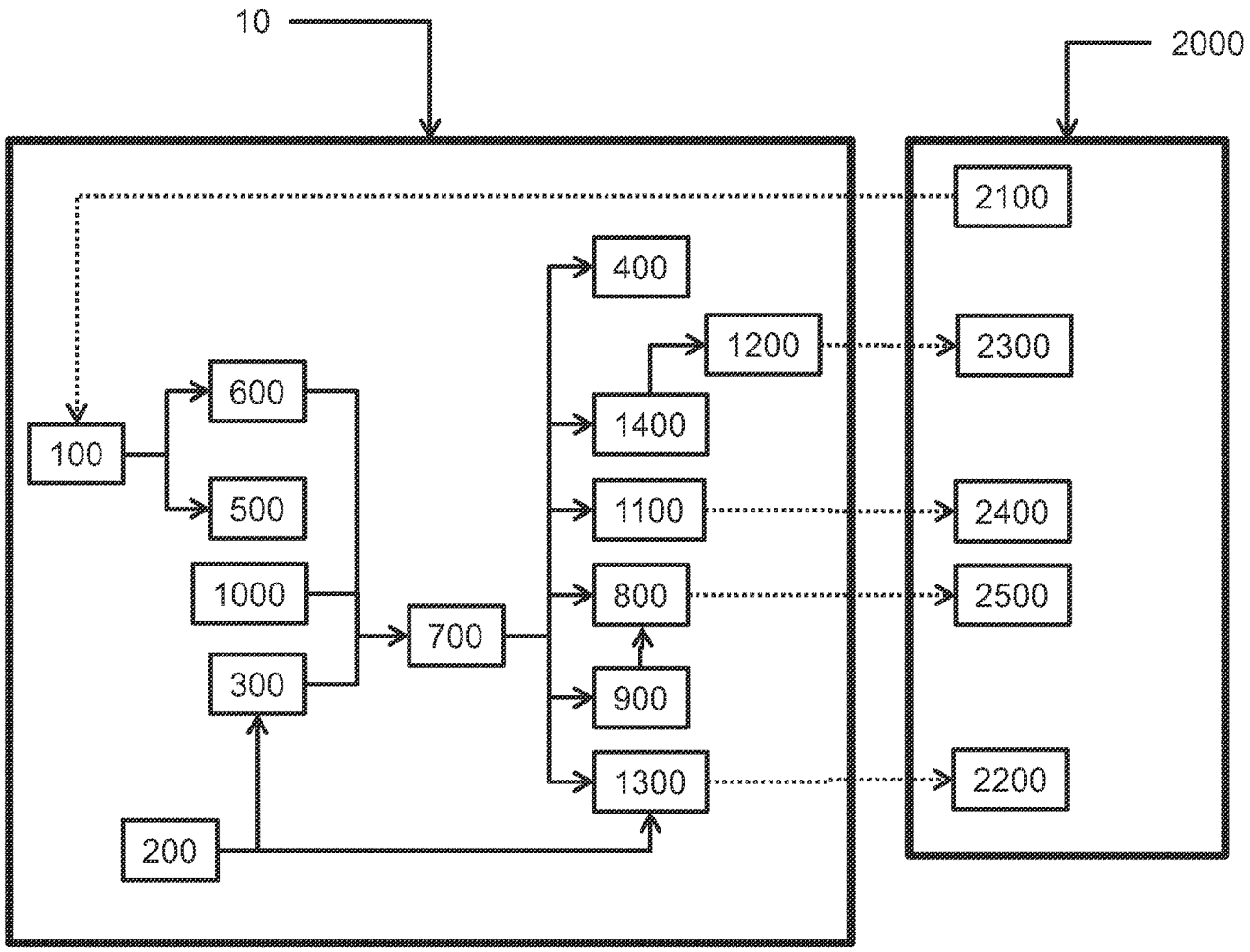
FIG. 2 (SHEET 2 OF 20 SHEETS) depicts a schematic view of a second embodiment of the apparatus of FIG. 1.

FIG. 2 depicts a schematic view of a second embodiment of the apparatus 10 of FIG. 1.

Referring to the embodiment depicted in FIG. 2, the apparatus 10 includes the sensor input signal conditioning circuit 100, the logic circuit 700, and the power output circuit 1300 of FIG. 1. In addition, the apparatus 10 (depicted in FIG. 2) further includes (any combination and permutation of a power input and protection circuit 200, a power supply circuit 300, a latched status indicator circuit 400, a sensor status indicator circuit 500, a sensor input opto-isolation circuit 600, a status indicator output circuit 800, a status indicator test input circuit 900, a logic reset input circuit 1000, an alarm output circuit 1100, a relay contacts circuit 1200, and a relay coil activation circuit 1400.

Referring to the embodiment depicted in FIG. 2, the apparatus 10 is further includes a sensor status indicator circuit 500. The sensor status indicator circuit 500 is also called an on-board logic status indicator circuit or an unlatched visual state indication circuit. The sensor status indicator circuit 500 is configured to receive the logic-converted status signal 101 (depicted in FIG. 1) from the sensor input signal conditioning circuit 100. The sensor status indicator circuit 500 is configured to provide a visual state indication of logic-converted signal.

Referring to the embodiment depicted in FIG. 2, the apparatus 10 is further includes a sensor input opto-isolation circuit 600. The sensor input opto-isolation circuit 600 is also called an isolation circuit. The sensor input opto-isolation circuit 600 is configured to receive the logic-converted status signal 101 provided by the sensor input signal conditioning circuit 100. The sensor input opto-isolation circuit 600 is configured to generate an isolated signal corresponding to the logic-converted status signal 101 provided by the sensor input signal conditioning circuit 100. The sensor input opto-isolation circuit 600 is configured to (C) provide the isolated signal.

Referring to the embodiment depicted in FIG. 2, the apparatus 10 is further adapted such that the logic circuit 700 is configured to receive the isolated signal provided by the sensor input opto-isolation circuit 600. The logic circuit 700 is further configured to convert the isolated signal into the latched output signal 701 (depicted in FIG. 1).

Referring to the embodiment depicted in FIG. 2, the apparatus 10 is further includes a latched status indicator circuit 400. The latched status indicator circuit 400 is also called a latched visual state indication circuit. The latched status indicator circuit 400 is configured to receive the latched output signal 701 provided by the logic circuit 700. The latched status indicator circuit 400 is configured to provide a visual state indication of the latched output signal 701.

Referring to the embodiment depicted in FIG. 2, the apparatus 10 is further includes a status indicator output circuit 800. The status indicator output circuit 800 is also called an off-board logic status indicator circuit or a latched state indication circuit. The status indicator output circuit 800 is configured to receive the latched output signal 701 provided by the logic circuit 700. The status indicator output circuit 800 is configured to provide an output indicating a state of the latched output signal 701 provided by the logic circuit 700 (to be connectable to a visual-monitoring circuit 2500 of the process machine 2000.

Referring to the embodiment depicted in FIG. 2, the apparatus 10 is further includes a status indicator test input circuit 900. The status indicator test input circuit 900 is also called an off-board logic status Indicator test circuit or a test circuit. The status indicator test input circuit 900 is configured to receive a test command signal (from a test switch). The status indicator test input circuit 900 is configured to provide the test command signal to a status indicator output circuit 800 in such a way that the status indicator output circuit 800 responds to the test command signal (to activate LED lights).

Referring to the embodiment depicted in FIG. 2, the apparatus 10 is further includes a logic reset input circuit 1000. The logic reset input circuit 1000 is also called a logic reset circuit or a latch-reset circuit. The logic reset input circuit 1000 is configured to receive a logic-reset command signal (from a logic-reset switch). The logic reset input circuit 1000 is also configured to provide the logic-reset command signal to the logic circuit 700 in such a way that the logic circuit 700 responds to the logic-reset command signal.

Referring to the embodiment depicted in FIG. 2, the apparatus 10 is further includes an alarm output circuit 1100. The alarm output circuit 1100 is also called an off-board alarm output circuit or an alarm circuit. The alarm output circuit 1100 is configured to receive the latched output signal 701 provided by the logic circuit 700. The alarm output circuit 1100 is also configured to generate an alarm signal corresponding to the latched output signal 701 provided by the logic circuit 700. The alarm output circuit 1100 is configured to provide the alarm signal to an alarm-monitoring circuit 2400 of the process machine 2000.

Referring to the embodiment depicted in FIG. 2, the apparatus 10 further includes a relay contacts circuit 1200. The relay contacts circuit 1200 is also called a control-state circuit. The relay contacts circuit 1200 is configured to receive the latched output signal 701 provided by the logic circuit 700. The relay contacts circuit 1200 is also configured to generate a state status signal corresponding to the latched output signal 701 provide by the logic circuit 700. The state status signal is configured to indicate a state of the latched output signal 701 provided by the logic circuit 700.

Referring to the embodiment depicted in FIG. 2, the apparatus 10 is further includes a relay coil activation circuit 1400. The relay coil activation circuit 1400 is configured to receive the state status signal provided by the relay contacts circuit 1200. The relay coil activation circuit 1400 is also configured to provide the state status signal to a state-monitoring circuit 2300 of the process machine 2000.

Referring to the embodiment depicted in FIG. 2, the apparatus 10 is further includes a power input and protection circuit 200 and a power supply circuit 300. The power input and protection circuit 200 is configured to receive and condition electric power. The power supply circuit 300 is for the logic circuit 700 (five volt for digital logic circuit). The power supply circuit 300 is configured to receive the electric power that was conditioned by the power input and protection circuit 200. The power supply circuit 300 is also configured to generate logic circuit power for the logic circuit 700.

FIGS. 3, 4A, 4B, 5, 6, 7, 8, 9A, 9B, 10, 11, 12, 13, 14, 15A, 15B, 15C and 16 depict detailed schematic views of a third embodiment of the apparatus 10 of FIG. 2.

Figure 3:
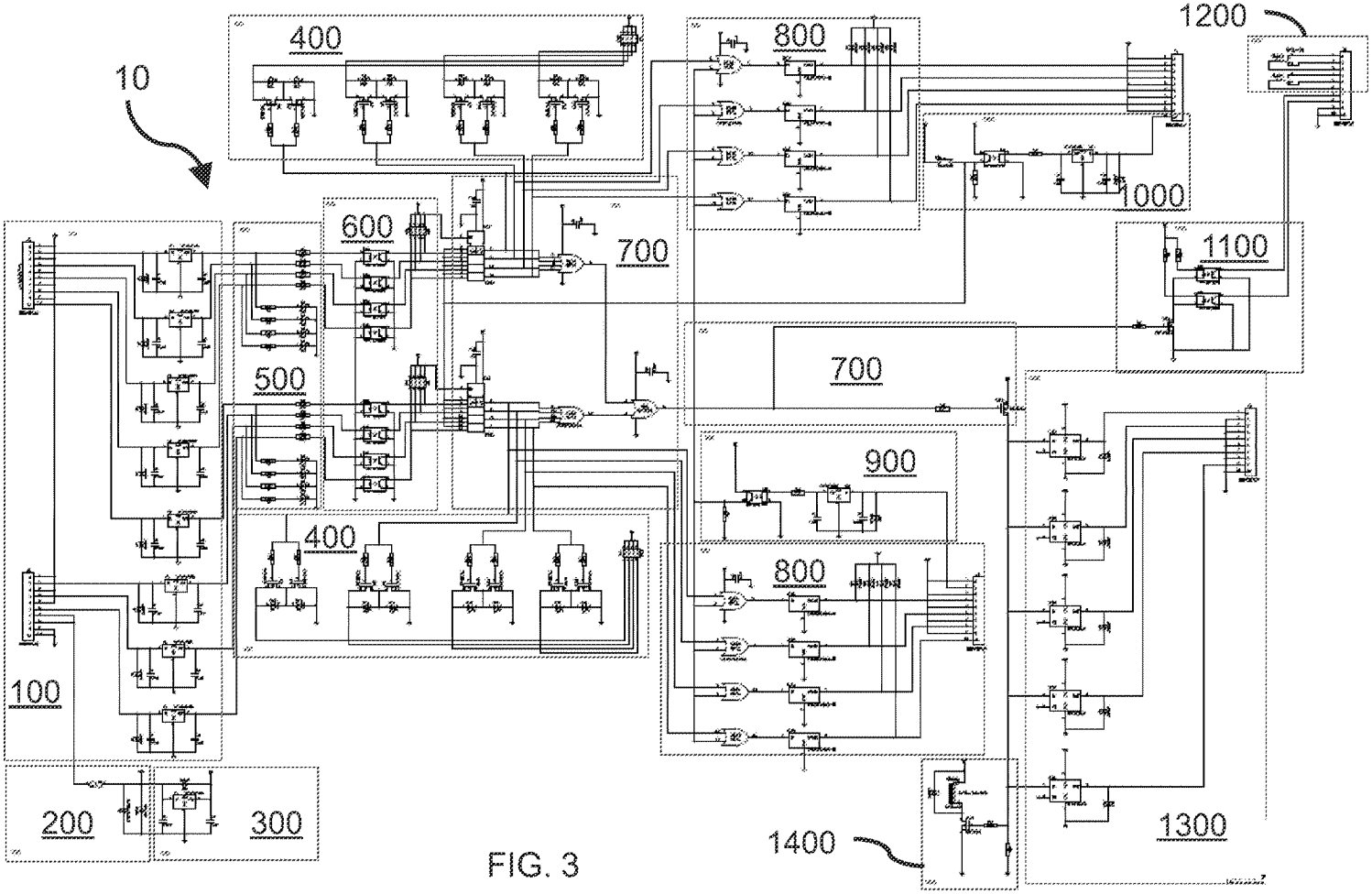
FIGS. 3, 4A, 4B, 5, 6, 7, 8, 9A, 9B, 10, 11, 12, 13, 14, 15A, 15B, 15C and 16 (SHEETS 3 to 20 OF 20 SHEETS) depict detailed schematic views of a third embodiment of the apparatus of FIG. 2.

As depicted in FIG. 3, the apparatus 10 having the circuits 100 to 1400 are mounted to a printed circuit board (PCB). It will be appreciated persons of skill in the art would be able to develop additional embodiments of the apparatus 10 that are configured to operate in a similar way as the apparatus 10 depicted in FIGS. 1 to 16.

FIG. 3 depicts an overall view of the schematic of an embodiment of the apparatus 10 of FIG. 2.

The details for the apparatus 10 depicted in FIG. 3 are described in connection with FIGS. 4A, 4B, 5, 6, 7, 8, 9A, 9B, 10, 11, 12, 13, 14, 15A, 15B, 15C and 16.

Figure 4A:
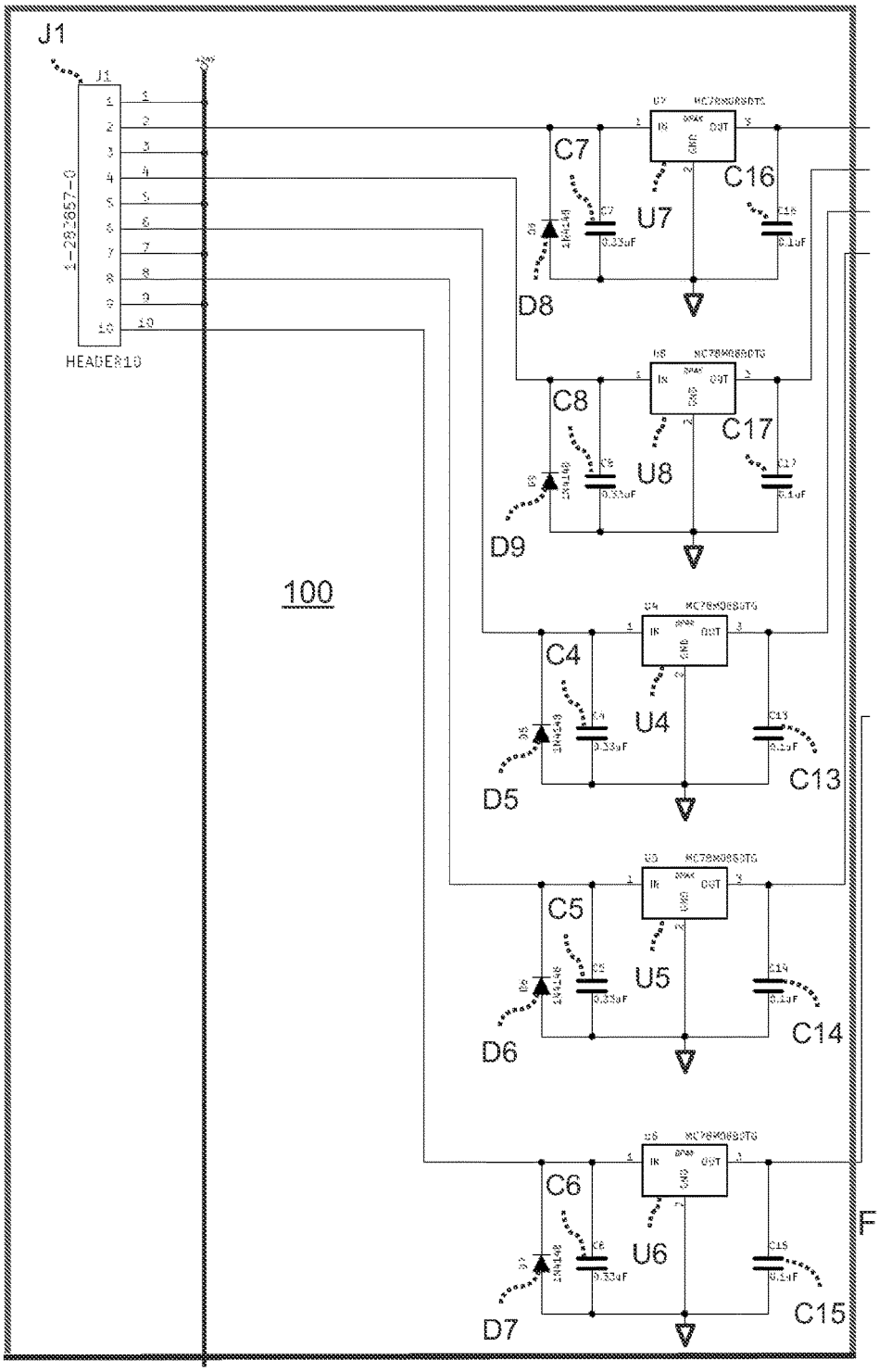
Figure 4B:
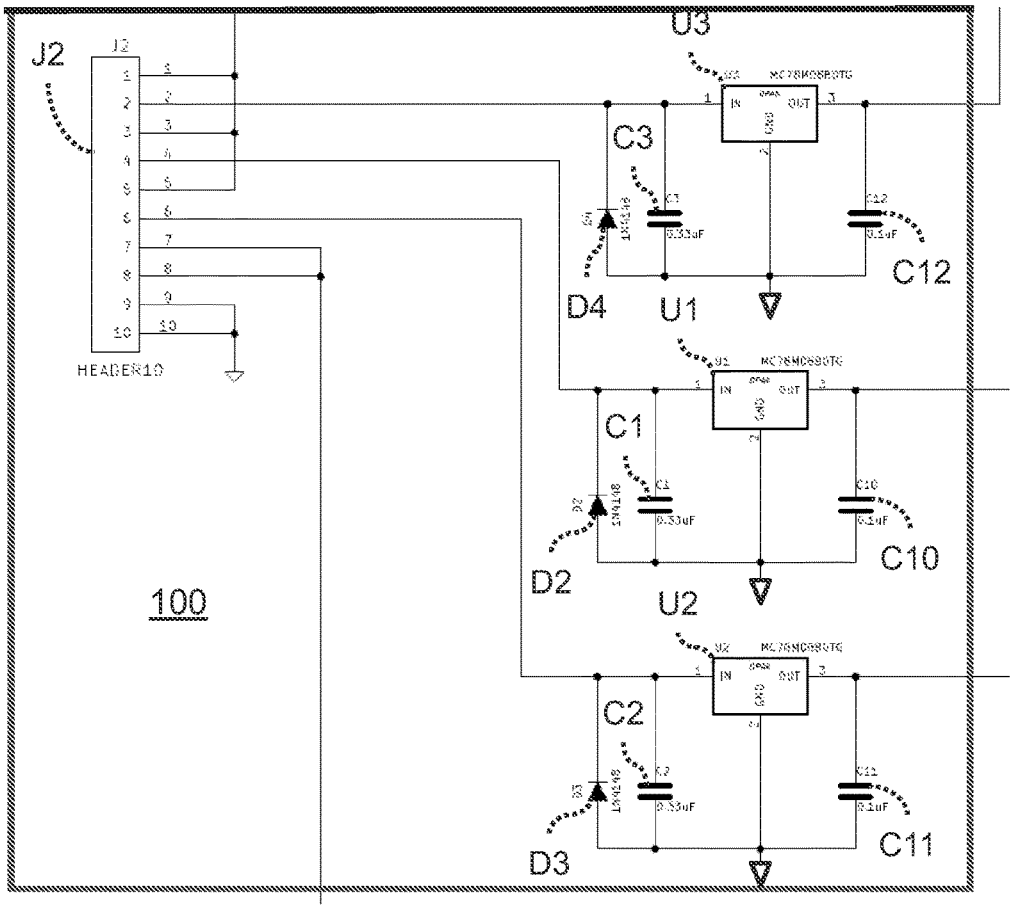

FIGS. 4A and 4B depict schematic view of the embodiment of the sensor input signal conditioning circuit 100 of the apparatus 10 of FIG. 3.

The sensor input signal conditioning circuit 100 includes terminal blocks J1 and J2, diodes D2, D3, D4, D5, D6, D7, D8 and D9, capacitors C1, C2, C3, C4, C5, C6, C7 and C8, capacitors C10, C11, C12, C13, C14, C15, C16 and C17, and voltage regulators U1 to U8. The terminal blocks J1 and J2 may include the 10 pin terminal block Model number 1-282857-0 manufactured by TE Connectivity (and any equivalent thereof). The diodes D2, D3, D4, D5, D6, D7, D8, and D9 may include the diode Model number 1N4148 (manufactured by Texas Instruments) and any equivalent thereof. The capacitors C1, C2, C3, C4, C5, C6, C7, and C8 may include the 0.33 microfarad capacitor and any equivalent thereof. The capacitors C10, C11, C12, C13, C14, C15, C16, and C17 may include the 0.1 microfarad capacitor and any equivalent thereof. The voltage regulators U1 to U8 may include the voltage regulator Model MC78M08BDTG manufactured by Fairchild Semiconductor (and any equivalent thereof).

The sensor input signal conditioning circuit 100 is configured to connect a quantity of eight off-board normally closed switch sensors on the process machine 2000 (such as, the pump jack system 2002 depicted in FIG. 1) to the sensor status indicator circuit 500. The sensor input signal conditioning circuit 100 is configured to take the voltage outputs between 12 to 24 volts from the eight sensors and reduce the voltage to eight (8) volts. The sensor input signal conditioning circuit 100 is also configured to filter out electrical noise and voltage spikes to prevent false sensor readings and to protect the circuits of the apparatus 10 depicted in FIG. 3.

Figure 5:
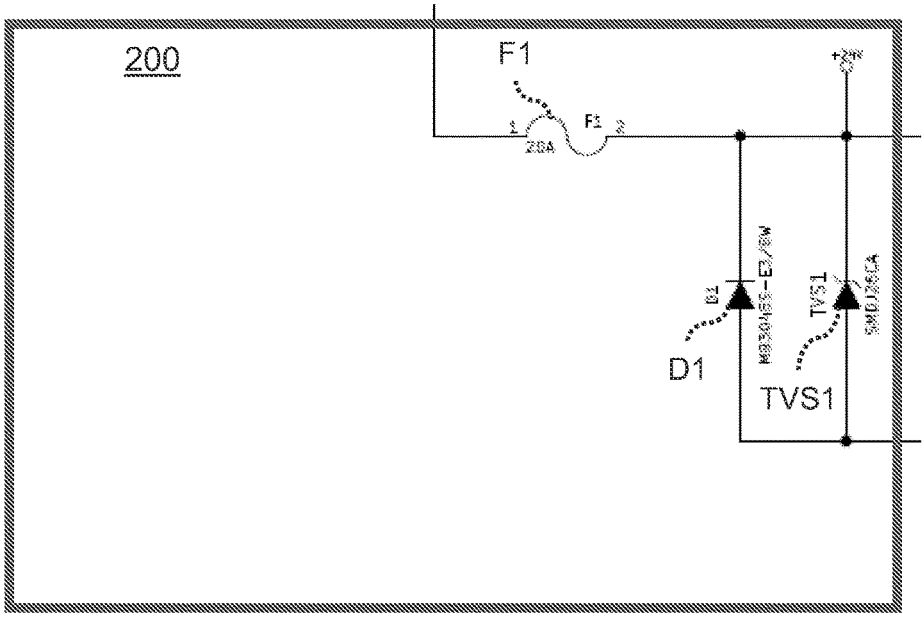
Figure 5:
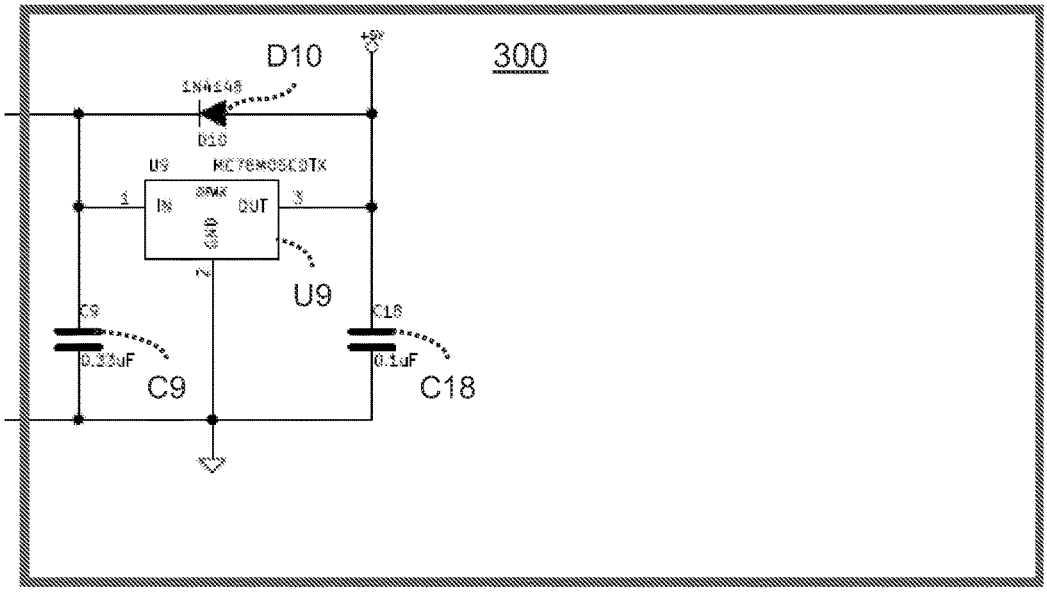

FIG. 5 depicts an overall view of the schematic of embodiment of the protection circuit 200 and the power supply circuit 300 of the apparatus 10 of FIG. 3.

The protection circuit 200 includes a fuse F1, a diode D1 (MB3045S-E3/8 W and a transient-voltage-suppression diode TVS1. The fuse F1 may include the 20 ampere fuse (and any equivalent thereof). The diode D1 may include the schottky diode Model number MB3045S-E3/8 W manufactured by Vishay General Semiconductor (and any equivalent thereof). The transient-voltage-suppression diode TVS1 may include the diode Model number SMDJ26CA manufactured by Littelfuse Incorporated (and any equivalent thereof).

The protection circuit 200 is configured to provide power for the circuits of the apparatus 10. The protection circuit 200 includes a fuse configured for over current protection, a TVS diode configured to clamp the input voltage at 32 volts, and a reverse polarity protection diode. In the event that the input voltage exceeds 32 volts, the TVS diode will provide a low resistance path to ground and thereby cause the fuse to blow (activate). For the case where the input voltage polarity is reversed, the protection diode is configured to provide a low resistance path to ground that causes the fuse to blow.

The power supply circuit 300 includes a diode D10, a capacitor C9, a capacitor C18, and a voltage regulator U9. The diode D10 may include diode Model number 1N4148 (manufactured by Texas Instruments) and any equivalent thereof. The capacitor C9 may include the 0.33 microfarad capacitor and any equivalent thereof. The capacitor C18 may include the 0.1 microfarad capacitor and any equivalent thereof. The voltage regulator U9 may include the voltage regulator Model MC78M05CDTX manufactured by Fairchild Semiconductor (and any equivalent thereof).

The power supply circuit 300 is configured to provide five (5) volts to the various circuits of the apparatus 10 of FIG. 3. The amperage capacity of the power supply circuit 300 is configured to provide about 500 milliamperes (mA). The power supply circuit 300 includes a five volt linear regulator with capacitors placed at the input and output of the voltage regulator for filtering the power delivered to the circuits of the apparatus 10 of FIG. 3. A diode connected across the voltage regulator's input and output terminals, provides a low resistance path for the stored charged from decoupling capacitors in case a short occurs on the voltage regulator's output.

Figure 6:
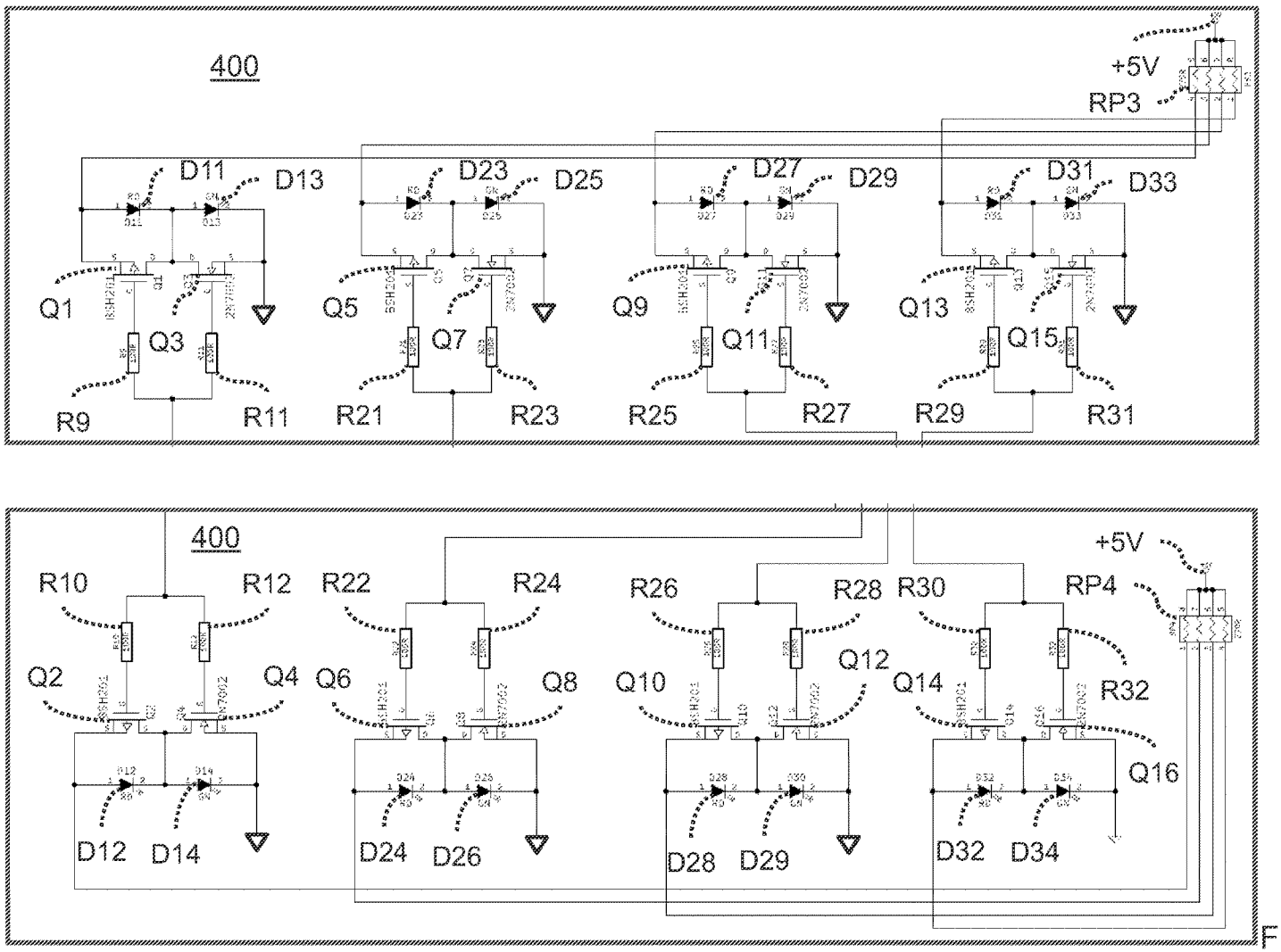

FIG. 6 depicts an overall view of the schematic of embodiment of the latched status indicator circuit 400 of the apparatus 10 of FIG. 3.

The latched status indicator circuit 400 includes resistors R9 to R12, resistors R21 to R32, resistor packs RP3 and RP4, lamps D11 to D32, and Q1, Q2, Q5, Q6, Q9, Q10, Q13, Q14, and transistors Q3, Q4, Q7, Q8, Q11, Q12, Q15, Q16. The resistors R9 to R12 and the resistors R21 to R32 may include 100 ohm resistors (and any equivalent thereof). The resistor packs RP3 and RP4 may include a quantity of four 270 ohm resistors (and any equivalent thereof). The lamps D11, D12, D23, D24, D27, D28, D31, and D32 may include the red colored light emitting diode Model number LTST-C150KRKT manufactured by Lite-On Incorporated (and any equivalent thereof). The lamps D13, D14, D25, D26, D29, D30, D33, and D34 may include the green colored light emitting diode Model number LTST-C150KGKT manufactured by Lite-On Incorporated (and any equivalent thereof). The transistors Q1, Q2, Q5, Q6, Q9, Q10, Q13, and Q14 may include the MOS FET transistor Model number BSH201 manufactured by Philips Semiconductors (and any equivalent thereof). The transistors Q3, Q4, Q7, Q8, Q11, Q12, Q15, Q16 may include the MOSFET transistor Model number 2N7002 manufactured by Fairchild Semiconductors (and any equivalent thereof).

The latched status indicator circuit 400 is connected to the logic circuit 700. The latched status indicator circuit 400 includes eight red LED indicators (lamps) and eight green LED indicators (lamps) located on the printed circuit board. The latched status indicator circuit 400 is configured to illuminate a red indicator or green indicator depending on the status of an input connected to the sensor input signal conditioning circuit 100. For the case where an off-board sensor opens, the latched status indicator circuit 400 is configured to turn on a red LED and turn off a green LED. Preferably, there is always one status indicator on per input. Preferably, by pushing an on-board reset button (switch) or an off-board reset button will turn all on-board status indicators green, providing that all off-board sensors are closed.

Figure 7:
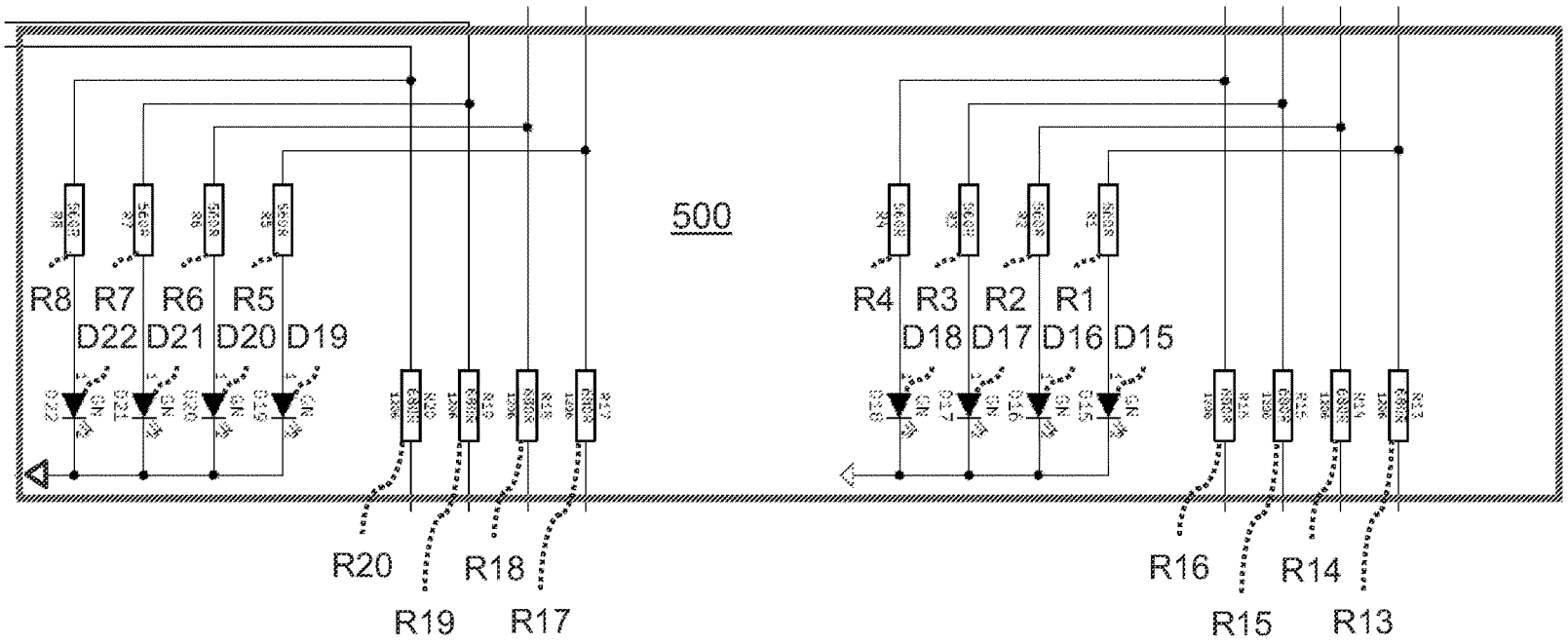

FIG. 7 depicts an overall view of the schematic of an embodiment of the sensor status indicator circuit 500 of the apparatus 10 of FIG. 3.

The sensor status indicator circuit 500 includes resistors R1 to R8, resistors R13 to R20, lamps D15 to D18.

The resistors R1 to R8 may include 560 ohm resistors (and any equivalent thereof). The resistors R13 to R20 may include 680 ohm resistors (and any equivalent thereof). The lamps D15 to D18 may include green colored light emitting diodes Model number LTST-C150KGKT manufactured by Lite-On Incorporated (and any equivalent thereof).

The sensor status indicator circuit 500 is configured to connect the sensor input signal conditioning circuit 100 to the sensor input opto-isolation circuit 600. The sensor status indicator circuit 500 is configured to illuminate a green light emitting diode (located on the printed circuit board) for the case where an off-board sensor (not depicted but known) has been connected (to the sensor input signal conditioning circuit 100) and is correctly functioning. There are a total of eight sensor status indicators (one for each sensor input). For the case where an off-board sensor (not depicted but known) has been opened (switch open), or is not connected to the sensor input signal conditioning circuit 100, the lamp or LED indicator will not illuminate (on the printed circuit board).

Figure 8:
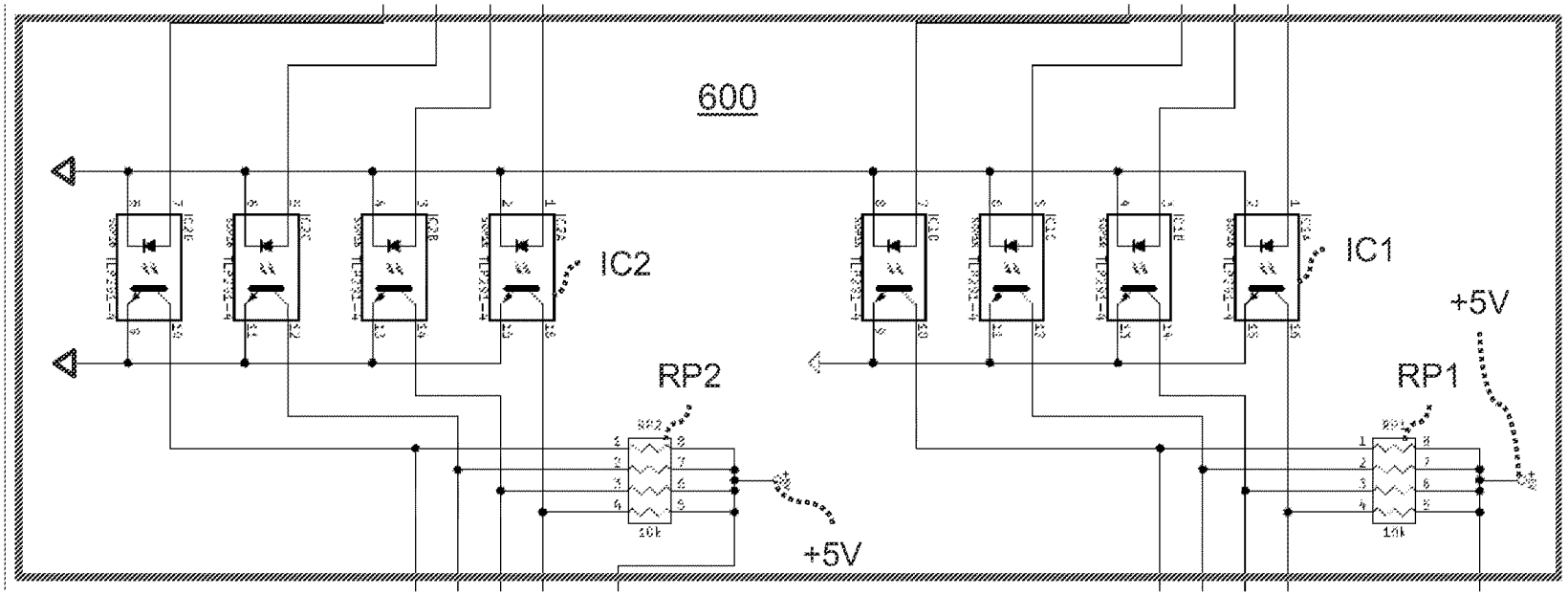

FIG. 8 depicts an overall view of the schematic of an embodiment of the sensor input opto-isolation circuit 600 of the apparatus 10 of FIG. 3.

The sensor input opto-isolation circuit 600 includes a transistor output photocoupler IC1, a transistor output photocoupler, a resistor pack RP1 and a resistor pack RP2.

The transistor output photocoupler IC1 may include the transistor output photocoupler Model number TLP291-4 manufactured by Toshiba (and any equivalent thereof). The transistor output photocoupler IC2 may include the transistor output photocoupler Model number TLP291-4 manufactured by Toshiba (and any equivalent thereof). The resistor pack RP1 may include a quantity of four 10 kilo-ohm resistors (and any equivalent thereof). The resistor pack RP2 may include a quantity of four 10 kilo-ohm resistors (and any equivalent thereof).

The sensor input opto-isolation circuit 600 is configured to connect the sensor status indicator circuit 500 to the logic circuit 700. The sensor input opto-isolation circuit 600 is configured to protect the logic circuit 700 from a high voltage condition, high voltage spikes, and/or sever unknown electrical noise that may occur in an industrial environment. The sensor input opto-isolation circuit 600 is configured to electrically isolate the logic circuit 700 from the sensor input signal conditioning circuit 100.

Figure 9A:
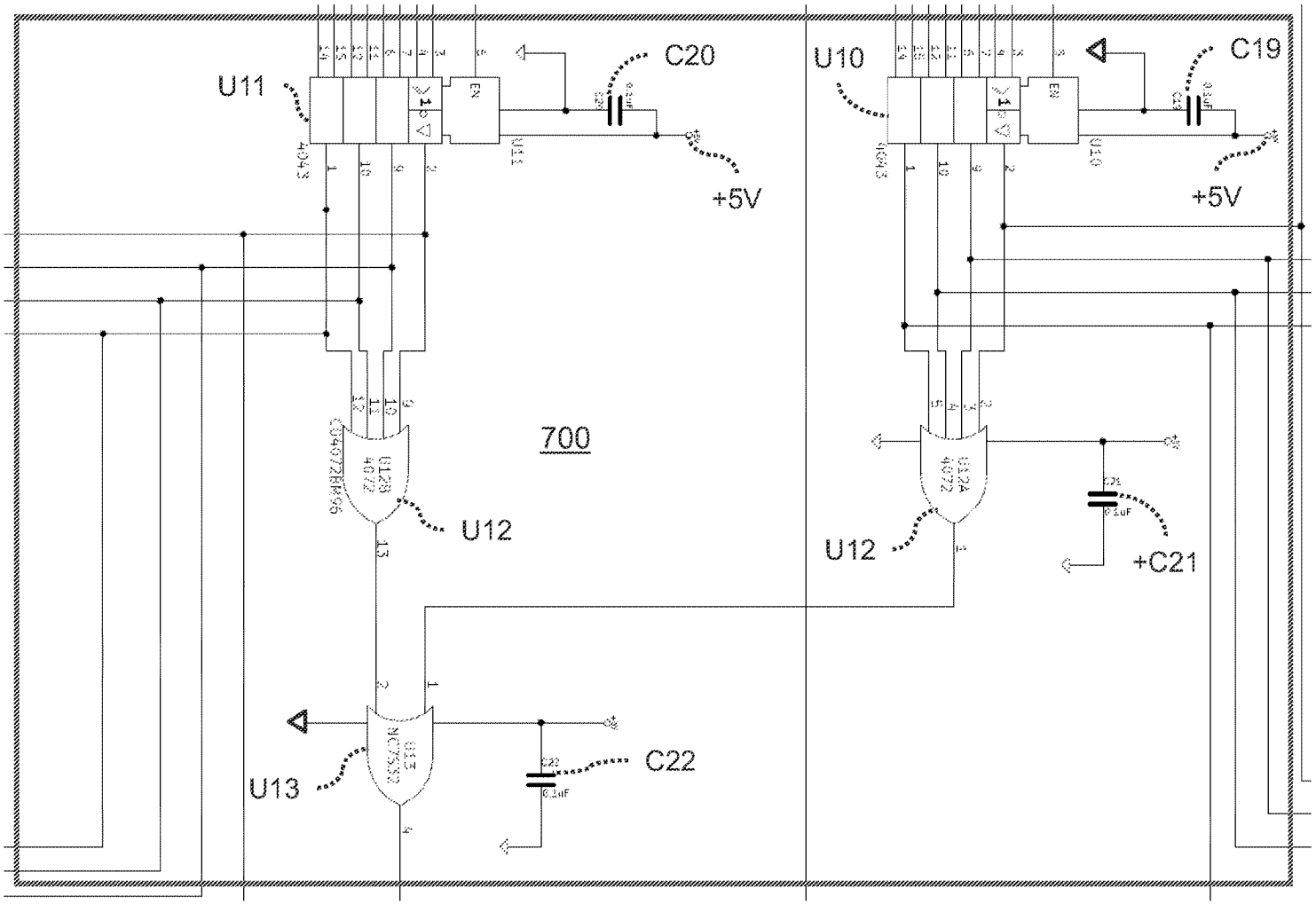
Figure 9B:
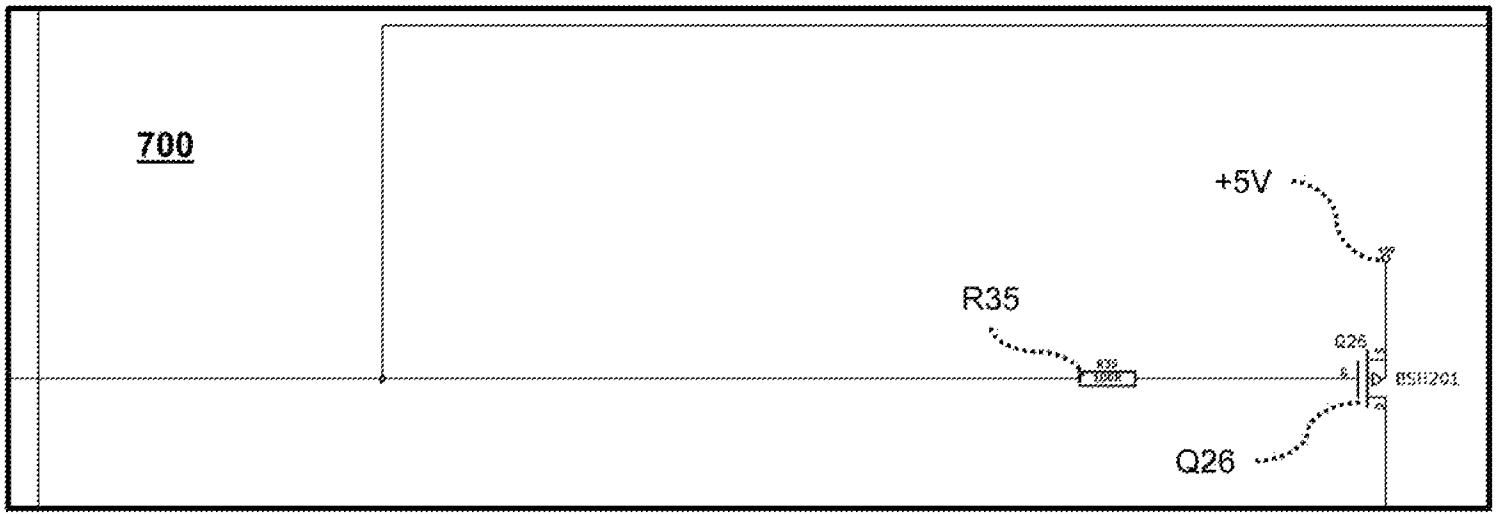

FIGS. 9A and 9B depict overall views of the schematic of an embodiment of the logic circuit 700 of the apparatus 10 of FIG. 3.

The logic circuit 700 includes a capacitor C19, a capacitor C20, a capacitor C21, a capacitor C22, a resistor R35, a transistor Q26, a latch device U10, a latch device U11, an OR logic gate U12 (also called, a logic circuit), and an OR logic gate U13 (also called, a logic circuit).

The capacitor C19 may include the 0.1 mircofarad capacitor (and any equivalent thereof). The capacitor C20 may include the 0.1 mircofarad capacitor (and any equivalent thereof). The capacitor C21 may include the 0.1 mircofarad capacitor (and any equivalent thereof). The capacitor C22 may include the 0.1 mircofarad capacitor (and any equivalent thereof). The resistor R35 may include the 100 ohm resistor (and any equivalent thereof). The transistor Q26 may include the MOS FET transistor Model number BSH201 manufactured by Philips Semiconductors (and any equivalent thereof). The latch device U10 may include the quad NOR R/S latch Model number CD4043B manufactured by Texas Instruments (and any equivalent thereof). The latch device U11 may include the quad NOR R/S latch Model number CD4043B manufactured by Texas Instruments (and any equivalent thereof). The OR logic gate U12 may include the dual 4-input OR logic gate Model number CD4072BM96 manufactured by Texas Instruments (and any equivalent thereof). The OR logic gate U13 may include the 2-input OR gate Model number NC7S32 manufactured by Fairchild Semiconductor (and any equivalent thereof).

The logic circuit 700 is configured to monitor the eight inputs (associated with the sensor input signal conditioning circuit 100). For the case where all eight inputs (associated with the sensor input signal conditioning circuit 100) are closed, the logic circuit 700 is configured to drive four power outputs into the ON state, energizes a relay coil, and illuminates the on-board status indicators (lamps or diodes) to a GREEN state for each input (that is detected to be in the CLOSED state). For the case where one of the inputs (associated with the sensor input signal conditioning circuit 100) opens or switches to the OFF state, the logic circuit 700 is configured to shut off the power outputs and de-energizes the relay coil. The logic circuit 700 is also configured to activate the two alarm inputs that provides a path to circuit ground, and is also configured to illuminate an on-board indicator to a RED state (indication state) that corresponds to the open input (associated with the sensor input signal conditioning circuit 100). The logic circuit 700 is configured to remain in a tripped (latched) state until a user pushes an off-board reset button.

Figure 10:
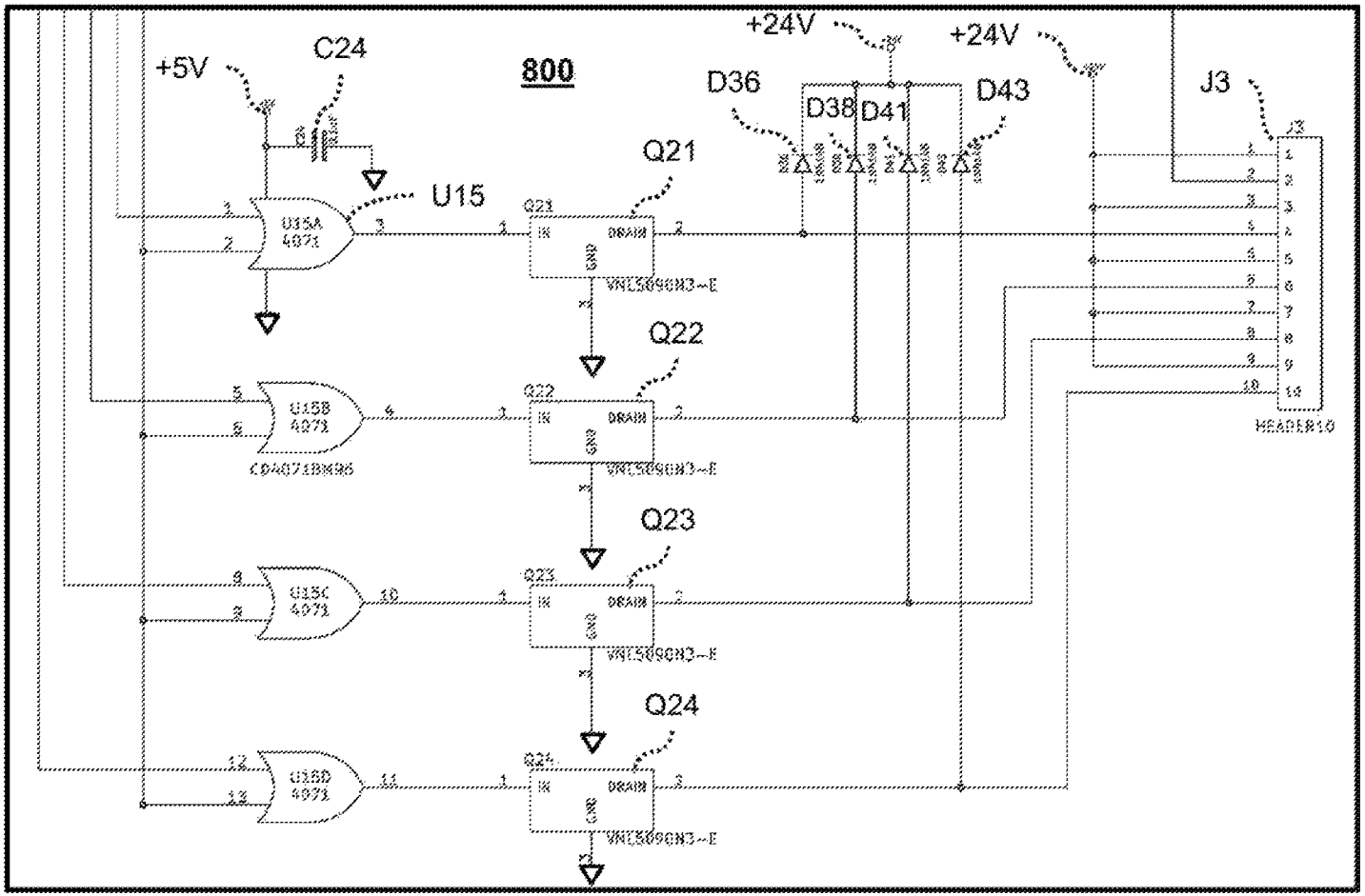

FIG. 10 depicts an overall view of the schematic of an embodiment of the status indicator output circuit 800 of the apparatus 10 of FIG. 3.

The status indicator output circuit 800 includes a capacitor C24, transistors Q21 to Q24, diodes D36 to D43, a quad 2-input OR gate 15 (also called a logic circuit), and a terminal block J3. The capacitor C24 may include the 0.1 microfarad capacitor (and any equivalent thereof). The transistors Q21 to Q24 may include the field-effect transistor Model number VNL5090N3-E manufactured by ST Microelectronics (and any equivalent thereof). The diodes D36 to D43 may include diode Model number 1N4148 (manufactured by Texas Instruments) and any equivalent thereof. The quad 2-input OR gate 15 may include quad 2-input OR gate Model number CD4071BC manufactured by Fairchild Semiconductor (and any equivalent thereof). The terminal block J3 includes the 10 pin terminal block Model number 1-282857-0 manufactured by TE Connectivity (and any equivalent thereof).

The status indicator output circuit 800 is configured to monitor each output of the latches in the logic circuit 700. The status indicator output circuit 800 is also configured to turn on the transistors Q21 to Q24 (the field-effect transistor model number VNL5090N3-E) to drive an off-board indicator lamp (not depicted but known). An OR-gate logic circuit for each lamp indicator is configured to allow another input from the status indicator test input circuit 900 to turn on all of the indicators in such a way as to test valid functionality of the indicators. A total of eight off-board indicators may be illuminated using the status indicator output circuit 800, in which there is one indicator for each input in the sensor input signal conditioning circuit 100. When a sensor open circuits in the process machine 2000, the corresponding indicator (driven from the status indicator test input circuit 900) may illuminate, and stay illumined until the logic reset input circuit 1000 is activated. For the case where the logic reset input circuit 1000 is activated, all of the off-board indicators will turn off, provided that all sensors in process machine 2000 are in a closed state.

Figure 11:
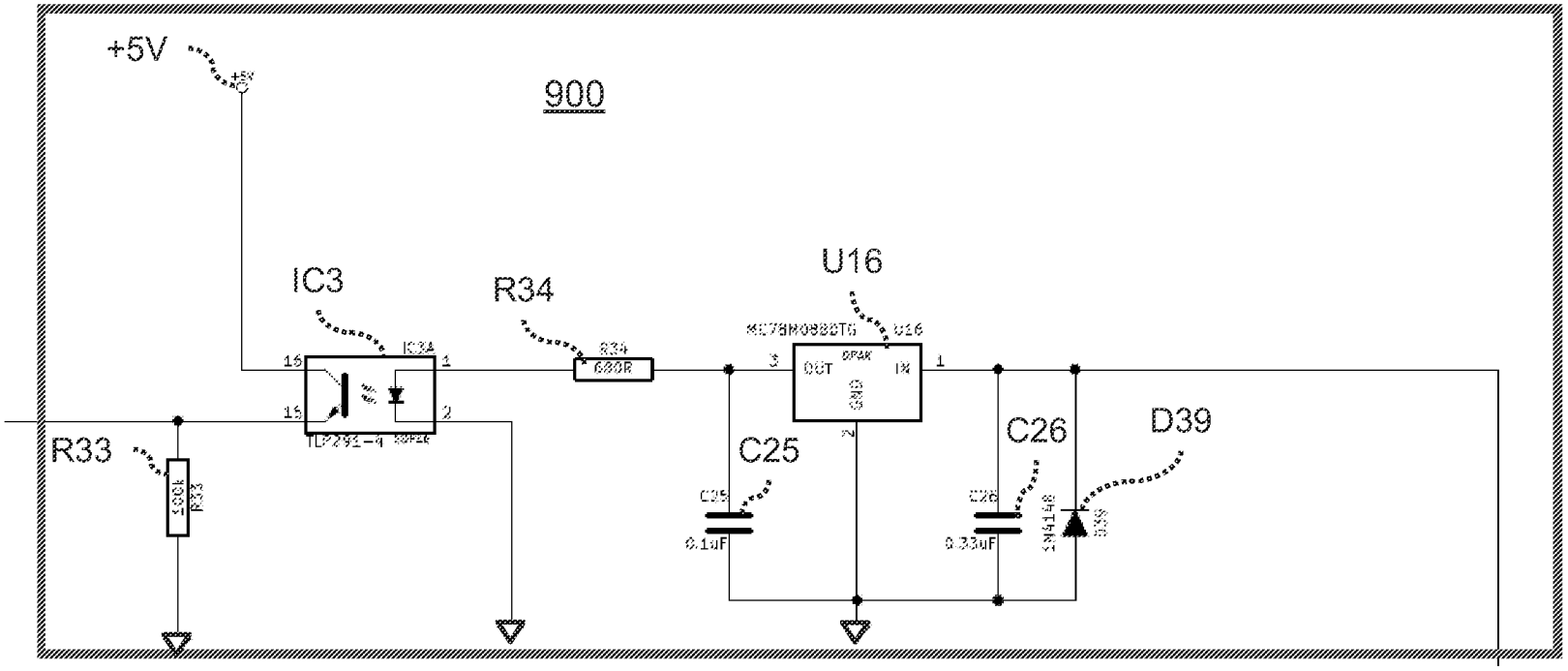

FIG. 11 depicts an overall view of the schematic of an embodiment of the status indicator test input circuit 900 of the apparatus 10 of FIG. 3.

The status indicator test input circuit 900 may include the resistor R33, a resistor R34, a capacitor C25, a capacitor C26, a transistor output photocoupler IC3A, and an integrated circuit U16. The resistor R33 may include the 100 kilo-ohm resistor (and any equivalent thereof). The resistor R34 may include the 680 ohm resistor (and any equivalent thereof). The capacitor C27 may include the 0.1 microfarad capacitor (and any equivalent thereof). The capacitor C28 may include the 0.33 microfarad capacitor (and any equivalent thereof). The transistor output photocoupler IC3A may include integrated circuit Model number TLP291-4 manufactured by Toshiba (and any equivalent thereof). The voltage regulator U16 may include the voltage regulator Model MC78M08BDTG manufactured by Fairchild Semiconductor (and any equivalent thereof).

The status indicator test input circuit 900 is configured to output a logic high signal to the status indicator output circuit 800 and turn all indicators on. The status indicator test input circuit 900 is configured to test all off-board indicators in the visual-monitoring circuit 2500 to make sure all indicators function correctly. The status indicator test input circuit 900 is manually activated by the closing of a normally open switch (a push button) in a manual visual-monitoring test switch (known and not depicted).

Figure 12:
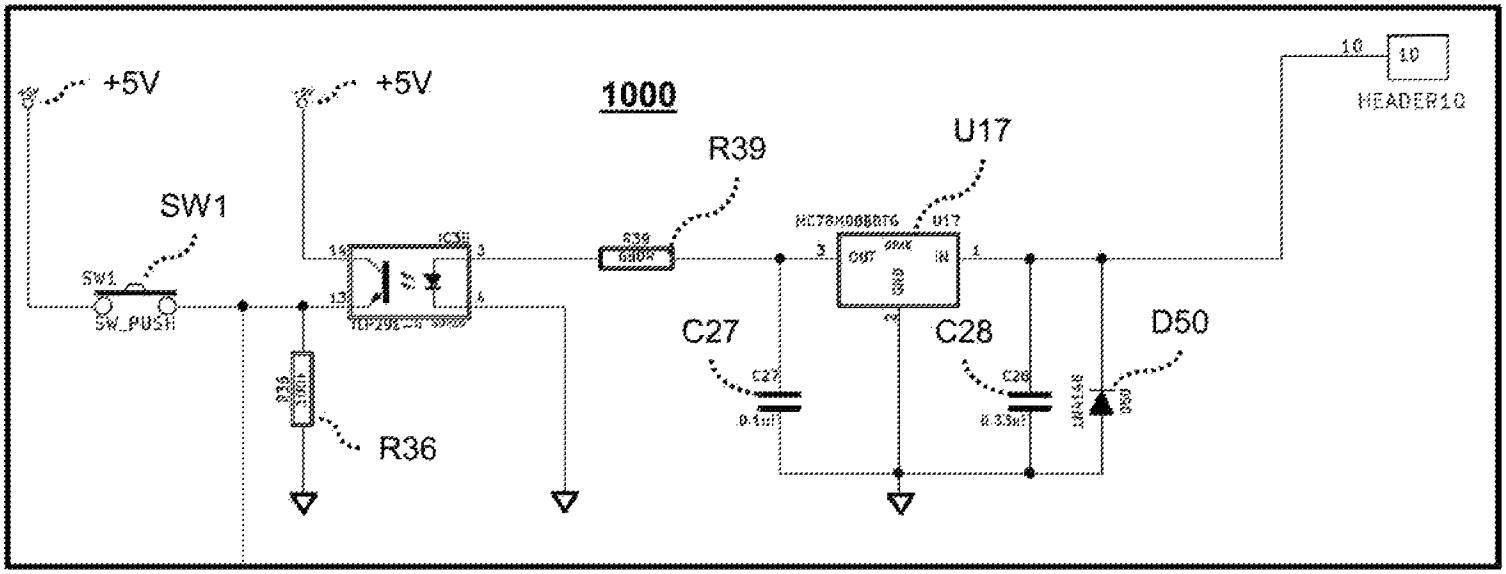

FIG. 12 depicts an overall view of the schematic of an embodiment of the logic reset input circuit 1000 of the apparatus 10 of FIG. 3.

The logic reset input circuit 1000 includes a push switch SW1, a resistor R36, a resistor R39, a capacitor C27, a capacitor C28, a diode D50, an integrated circuit U17, and a transistor output photocoupler IC3B. The push switch SW1 may include switch Model number PWR70Q1S manufactured by C&K Components (and any equivalent thereof). The resistor R36 may include the 100 kilo-ohm resistor (and any equivalent thereof). The resistor R39 may include the 680 ohm resistor (and any equivalent thereof). The capacitor C27 may include the 0.1 microfarad capacitor (and any equivalent thereof). The capacitor C28 may include the 0.33 microfarad capacitor (and any equivalent thereof). The diode D50 may include the diode Model number 1N4148 (manufactured by Texas Instruments) and any equivalent thereof. The voltage regulator U17 may include the voltage regulator Model MC78M08BDTG manufactured by Fairchild Semiconductor (and any equivalent thereof). The transistor output photocoupler IC3B may include integrated circuit Model number TLP291-4 manufactured by Toshiba (and any equivalent thereof).

The logic reset input circuit 1000 is configured to reset the logic circuit 700 (also called the latch circuit) so that all latch outputs are in a logic low state. Reset functionality is provided by pushing an on-board push button switch PWR70Q1S manufactured by C&K Components (or equivalent thereof) or by closing a normally open switch (push button) in a manual reset switch. The logic reset input circuit 1000 is configured to turn all latch outputs in a logic low state, provided that all sensors in process machine 2000 are closed. The manual reset switch (known and not depicted) is located off-board (located away from the apparatus 10), and is a normally open reset push button switch. The manual visual-monitoring test switch (known and not depicted) is located off-board (located away from the apparatus 10), and is a normally open push button switch. The manual reset switch and the manual visual-monitoring test switch are not physically on the printed circuit board (or part of the apparatus 10). The manual reset switch and the manual visual-monitoring test switch may be mounted nearby (the apparatus 10) in a panel or box. The manual reset switch and the manual visual-monitoring test switch may be included in the status indicator test input circuit 900 and the logic reset input circuit 1000 (if so desired).

Figure 13:
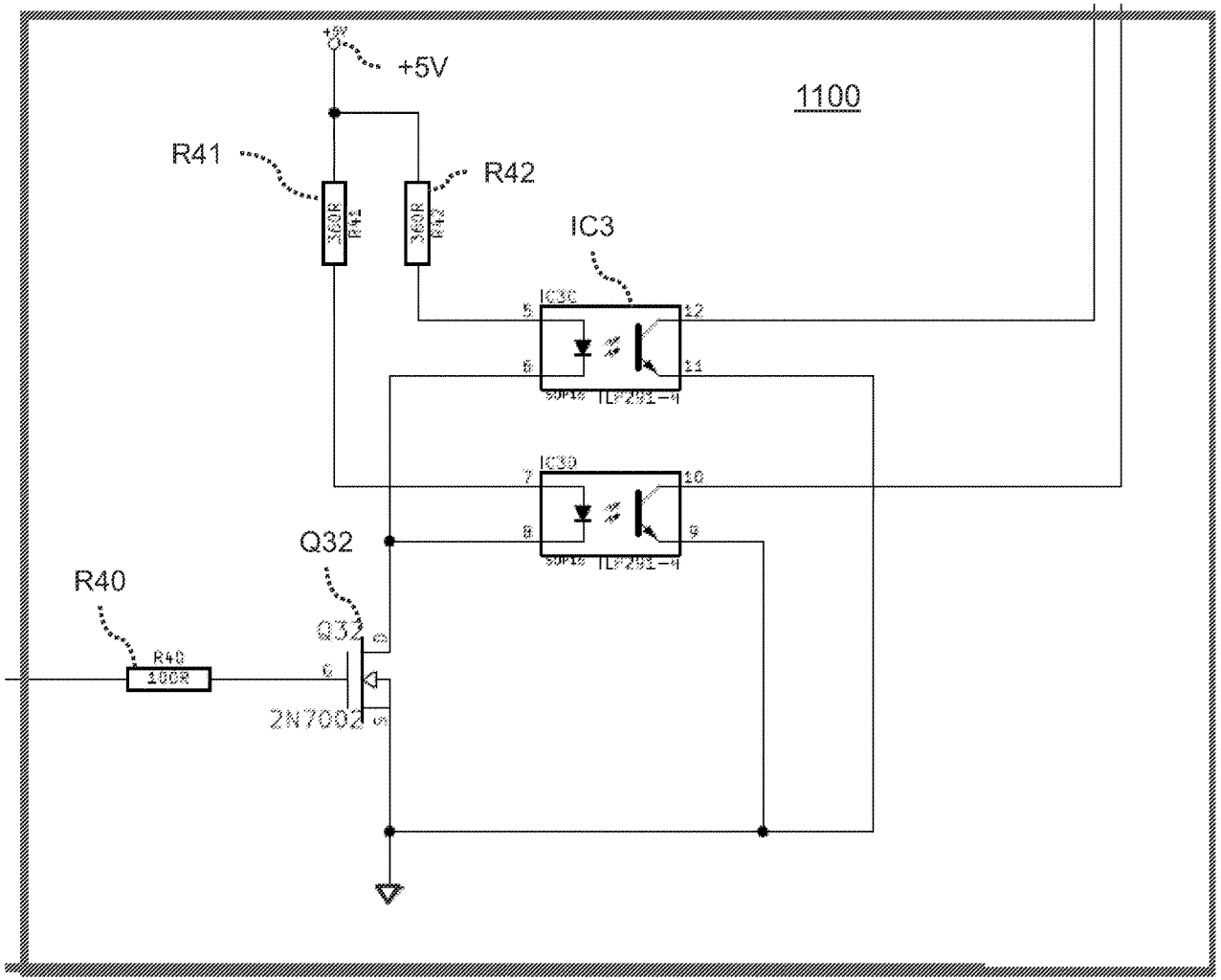

FIG. 13 depicts an overall view of the schematic of an embodiment of the alarm output circuit 1100 of the apparatus 10 of FIG. 3.

The alarm output circuit 1100 includes a resistor R40, a resistor R41, a resistor R42, a transistor Q32, a transistor output photocoupler IC3C, and a transistor output photocoupler IC3D.

The resistor R40 may include the 100 ohm resistor (and any equivalent thereof). The resistor R41 may include the 360 ohm resistor (and any equivalent thereof). The resistor R42 may include the 360 ohm resistor (and any equivalent thereof). The transistor Q32 may include the MOSFET transistor Model number 2N7002 manufactured by Fairchild Semiconductors (and any equivalent thereof). The transistor output photocoupler IC3C may include integrated circuit Model number TLP291-4 manufactured by Toshiba (and any equivalent thereof). The transistor output photocoupler IC3D may include integrated circuit Model number TLP291-4 manufactured by Toshiba (and any equivalent thereof).

The alarm output circuit 1100 is activated by a logic high for the case where the logic circuit 700 is activated when a sensor opens in the process machine 2000. When the alarm output circuit 1100 is activated, the transistor in the opto-isolator turns on, and provides a low impedance path to ground. The alarm output circuit 1100 interfaces with the alarm-monitoring circuit 2400, and is compatible with the alarm units that need a path to ground in order to activate. The alarm output circuit 1100 is configured to de-activate by activating logic reset input circuit 1000 providing all sensors in the process machine 2000 are closed.

Figure 14:
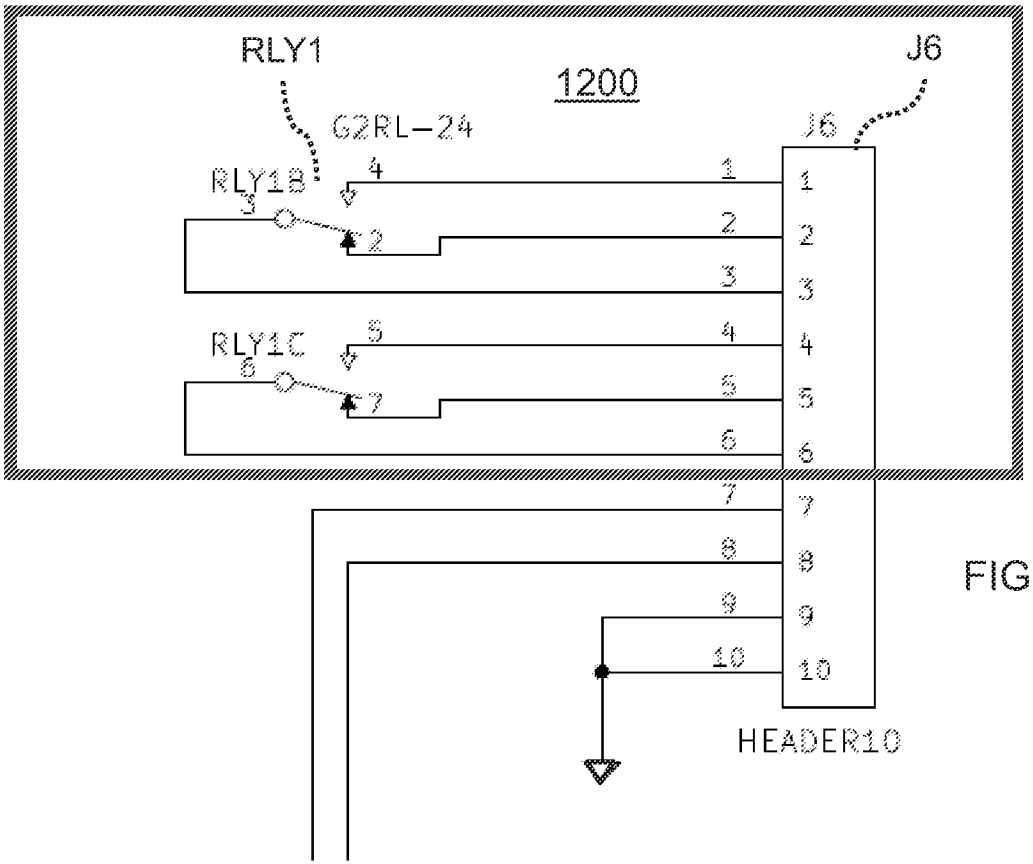

FIG. 14 depicts an overall view of the schematic of an embodiment of the relay contacts circuit 1200 of the apparatus 10 of FIG. 3.

The relay contacts circuit 1200 includes a relay RLY1B, a relay RLY1C, and a terminal block J6.

The relay RLY1B may include model Number G2RL-24. The relay RLY1C may include model Number G2RL-24. The terminal block J6 is the 10 pin terminal block Model number 1-282857-0 manufactured by TE Connectivity (and any equivalent thereof).

The relay contacts circuit 1200 is configured to activate for the case where the relay coil activation circuit 1400 is activated. The relay contacts circuit 1200 includes a double pole double throw contact configuration. When the relay contacts circuit 1200 is activated, the contacts in each pole switch (switch states). The relay contacts circuit 1200 is interfaced with the state-monitoring circuit 2300. The contacts in the relay contacts circuit 1200 will go back to the normal state for the case where the logic reset input circuit 1000 is activated providing that sensors in the process machine 2000 are closed.

Figure 15A:
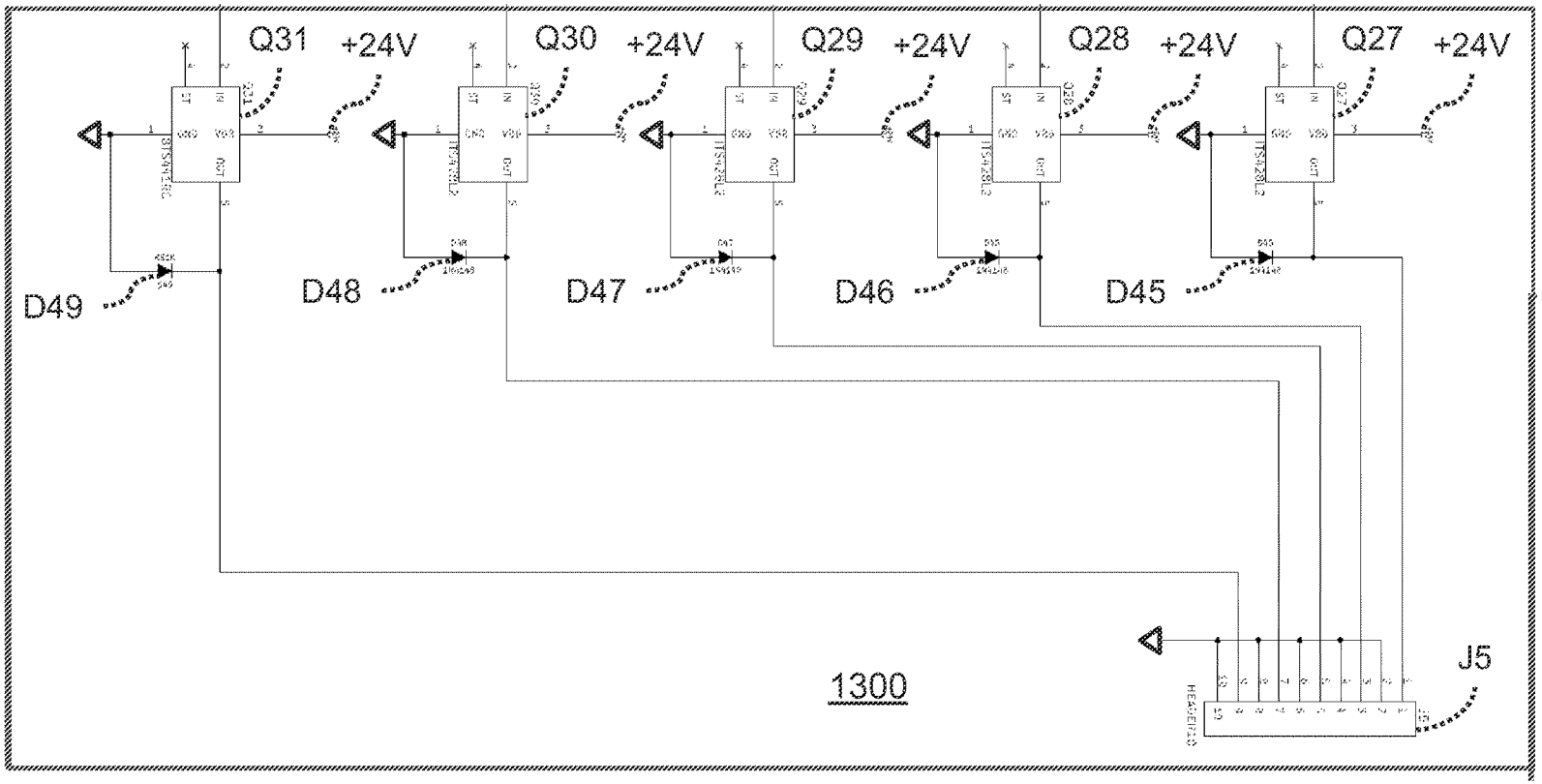
Figure 15B:
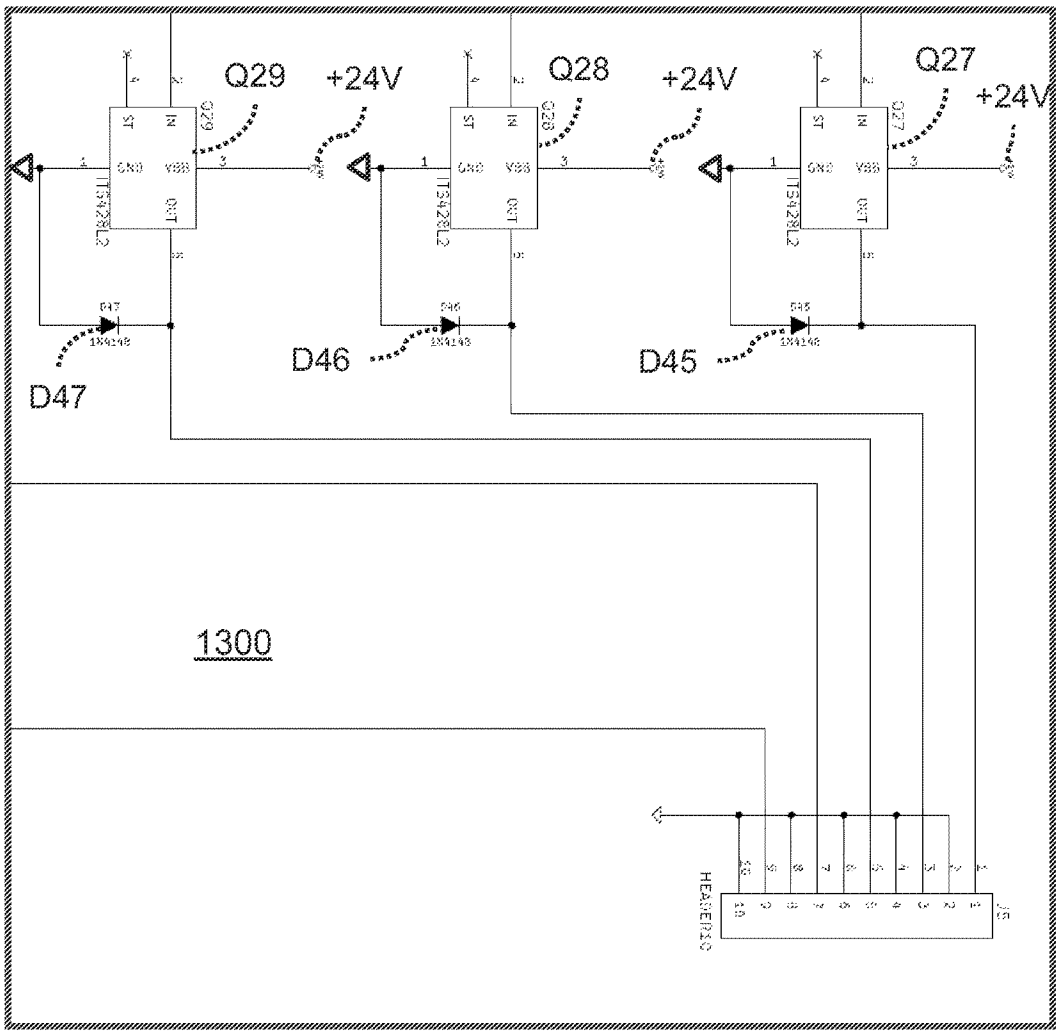
Figure 15C:
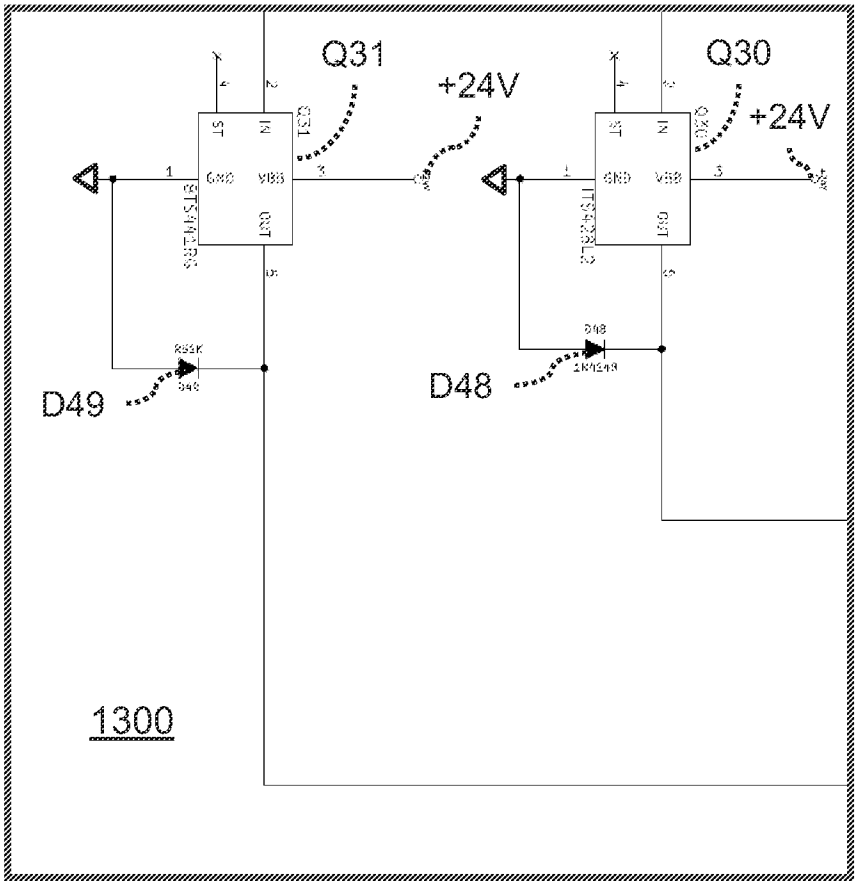

FIGS. 15A, 15B and 15C depict overall views of the schematic of an embodiment of the power output circuit 1300 of the apparatus 10 of FIG. 3. FIG. 15A depicts the entire instance of the power output circuit 1300. FIG. 15B depicts a portion of the power output circuit 1300. FIG. 15C depicts another portion of the power output circuit 1300.

The power output circuit 1300 includes power distribution switches Q27 to Q31, switching diodes D45 to D48, and a terminal block J5.

The power distribution switches Q27 to Q31 may include Model Number ITS428L2 manufactured by Infineon Technologies. Model Number ITS428L2 is an N channel vertical power MOSFET with charge pump, ground referenced CMOS compatible input and diagnostic feedback. The switching diodes D45 to D48 may include diode Model Number 1N4148 (manufactured by Texas Instruments) and any equivalent thereof. The terminal block J5 may include the 10 pin terminal block Model number 1-282857-0 manufactured by TE Connectivity (and any equivalent thereof).

The power output circuit is configured to provide power to the ignition coil for a gas powered motor (known and not depicted) that is powering the process machine 2000 or the pump jack system 2002 (the pump jack), and/or other process elements in the process machine 2000. When any sensor opens in the process machine 2000, the power output circuit 1300 is configured to; (A) de-energize the ignition coil which stalls the gas powered motor driving the process machine 2000, and (B) de-activate other process elements in the process machine 2000 (as may be required). By way of example (and not limited thereto) up to four process elements can be powered, and one ignition coil for the process machine 2000.

Figure 16:
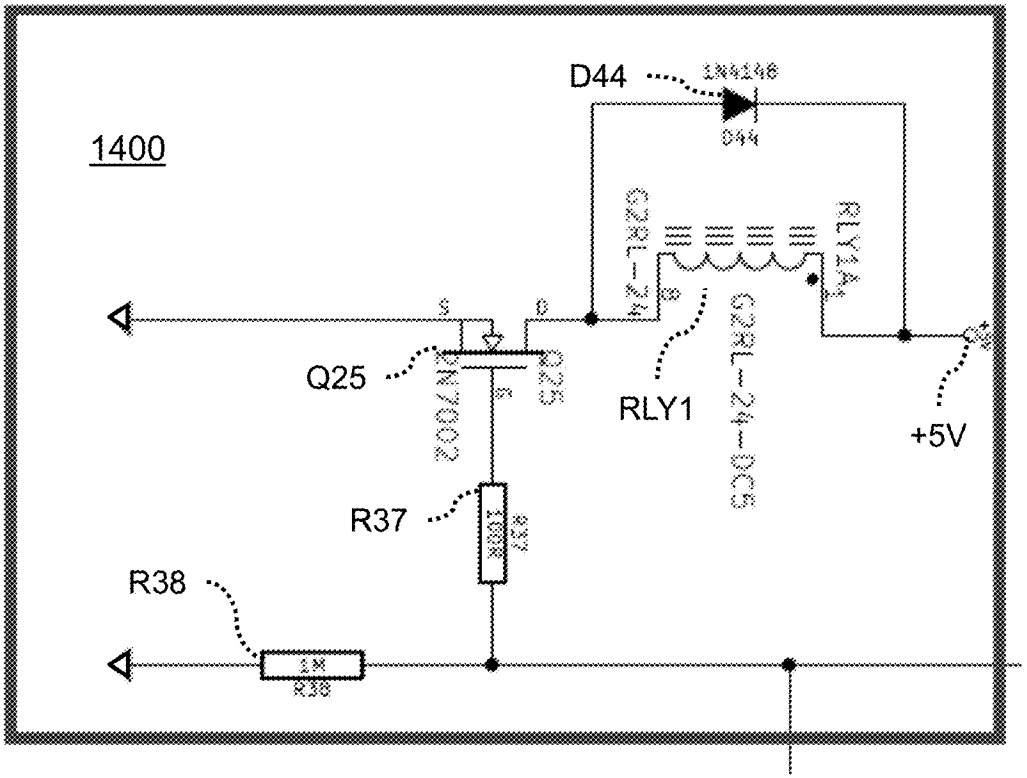

FIG. 16 depicts an overall view of the schematic of an embodiment of the relay coil activation circuit 1400 of the apparatus 10 of FIG. 3.

The relay coil activation circuit 1400 includes a diode D44, a transistor Q25, a resistor R37 includes a 100 ohm resistor, a resistor R38, and a relay RLYA 1A1.

The diode D44 may include the diode Model number 1N4148 (manufactured by Texas Instruments) and any equivalent thereof. The transistor Q25 may include the transistor Model number 2N7002. The resistor R37 may include the 100 ohm resistor. The resistor R38 may include the one mega ohm resistor. The relay RLYA 1A1 may include the relay Model number G2RL-24-DC5 manufactured by OMRON Electronics (and any equivalent thereof).

The relay coil activation circuit 1400 is configured to be deactivated by the logic circuit 700 for the case where a sensor opens in the process machine 2000. The relay coil activation circuit 1400 is configured to switch the double pole double throw contacts in the relay contacts circuit 1200. The relay coil activation circuit 1400 is configured to remain in a deactive state until the logic reset input circuit 1000 is activated, providing that sensors remain closed in the process machine 2000.

This written description uses examples to disclose the invention, including the best mode, and also to enable any person skilled in the art to make and use the invention. The patentable scope of the invention is defined by the claims, and may include other examples that occur to those skilled in the art. Such other examples are within the scope of the claims if they have structural elements that do not differ from the literal language of the claims, or if they include equivalent structural elements with insubstantial differences from the literal language of the claims.

It may be appreciated that the assemblies and modules described above may be connected with each other as required to perform desired functions and tasks within the scope of persons of skill in the art to make such combinations and permutations without having to describe each and every one in explicit terms. There is no particular assembly, or component that may be superior to any of the equivalents available to the person skilled in art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus for a process machine having a pump-jack system, a process-status switch being coupled to the pump-jack system, and a process-control element being coupled to the pump-jack system, the apparatus comprising:

a sensor input signal conditioning circuit configured to provide a logic-converted status signal representing a process-status signal associated with the process-status switch being coupled to the pump-jack system of the process machine;

a logic circuit configured to provide a latched output signal converted from the logic-converted status signal provided by the sensor input signal conditioning circuit, and the latched output signal having any one of a first latched state and a second latched state; and a power output circuit configured to execute any one of maintaining and disconnecting a voltage being applied to the process-control element, in which the process-control element is coupled to the pump-jack system, depending on the state of the latched output signal; and wherein:

the process-control element includes an ignition coil for a gas powered motor; and the power output circuit is further configured to provide power to the ignition coil for the gas powered motor that is powering the pump-jack system of the process machine; and in response to the process-status switch, in which the process-status switch is coupled to the pump-jack system, being opened, the power output circuit is configured to de-energize the ignition coil which stalls the gas powered motor powering the pump-jack system of the process machine.

2. The apparatus of claim 1, wherein:

the sensor input signal conditioning circuit is further configured to:

receive the process-status signal associated with the process-status switch of the process machine;

convert the process-status signal associated with the process-status switch into the logic-converted status signal; and provide the logic-converted status signal.

3. The apparatus of claim 2, wherein:

the logic circuit is further configured to:

receive the logic-converted status signal provided by the sensor input signal conditioning circuit;

convert the logic-converted status signal into the latched output signal, and the latched output signal having any one of the first latched state and the second latched state; and provide the latched output signal.

4. The apparatus of claim 3, wherein:

the first latched state indicates the logic-converted status signal provides an acceptable indication that the state of the process-status switch is acceptable; and the second latched state indicates the logic-converted status signal provides an unacceptable indication that the state of the process-status switch is unacceptable.

5. The apparatus of claim 4, wherein:

the power output circuit is further configured to:

receive the latched output signal provided by the logic circuit;

maintain the voltage being applied to the process-control element for the case where the latched output signal provided by the logic circuit exists in the first latched state; and disconnect the voltage being applied to the process-control element for the case where the latched output signal provided by the logic circuit exists in the second latched state.

6. The apparatus of claim 5, further comprising:

a sensor status indicator circuit configured to:

receive the logic-converted status signal from the sensor input signal conditioning circuit; and provide a visual state indication of logic-converted signal.

7. The apparatus of claim 5, further comprising:

a sensor input opto-isolation circuit configured to:

receive the logic-converted status signal provided by the sensor input signal conditioning circuit;

generate an isolated signal corresponding to the logic-converted status signal provided by the sensor input signal conditioning circuit; and provide the isolated signal.

8. The apparatus of claim 7, wherein:

the logic circuit is configured to:

receive the isolated signal provided by the sensor input opto-isolation circuit;

convert the isolated signal into the latched output signal.

9. The apparatus of claim 5, further comprising:

a latched status indicator circuit configured to:

receive the latched output signal provided by the logic circuit; and provide a visual state indication of the latched output signal.

10. The apparatus of claim 5, further comprising:

a status indicator output circuit configured to:

receive the latched output signal provided by the logic circuit; and provide an output indicating a state of the latched output signal provided by the logic circuit.

11. The apparatus of claim 5, further comprising:

a status indicator test input circuit configured to:

receive a test command signal; and provide the test command signal to a status indicator output circuit in such a way that the status indicator output circuit responds to the test command signal.

12. The apparatus of claim 5, further comprising:

a logic reset input circuit configured to:

receive a logic-reset command signal; and provide the logic-reset command signal to the logic circuit in such a way that the logic circuit responds to the logic-reset command signal.

13. The apparatus of claim 5, further comprising:

an alarm output circuit configured to:

receive the latched output signal provided by the logic circuit; and generate an alarm signal corresponding to the latched output signal provided by the logic circuit; and provide the alarm signal to an alarm-monitoring circuit of the process machine.

14. The apparatus of claim 5, further comprising:

a relay contacts circuit configured to:

receive the latched output signal provided by the logic circuit; and generate a state status signal corresponding to the latched output signal provide by the logic circuit, the state status signal configured to indicate a state of the latched output signal provided by the logic circuit.

15. The apparatus of claim 14, further comprising:

a relay coil activation circuit configured to:

receive the state status signal provided by the relay contacts circuit; and provide the state status signal to a state-monitoring circuit of the process machine.

16. The apparatus of claim 5, further comprising:

a power input and protection circuit configured to receive and condition electric power; and a power supply circuit for the logic circuit configured to receive the electric power that was conditioned by the power input and protection circuit, and to generate logic circuit power for the logic circuit.

17. The apparatus of claim 5, further comprising:

a status indicator test input circuit configured to:

receive a test command signal; and provide the test command signal to a status indicator output circuit in such a way that the status indicator output circuit responds to the test command signal;

a logic reset input circuit configured to:

receive a logic-reset command signal; and provide the logic-reset command signal to the logic circuit in such a way that the logic circuit responds to the logic-reset command signal.

18. The apparatus of claim 5, further comprising:

an alarm output circuit configured to:

receive the latched output signal provided by the logic circuit; and generate an alarm signal corresponding to the latched output signal provided by the logic circuit; and provide the alarm signal to an alarm-monitoring circuit of the process machine.

19. The apparatus of claim 5, further comprising:

a relay contacts circuit configured to:

receive the latched output signal provided by the logic circuit; and generate a state status signal corresponding to the latched output signal provide by the logic circuit, the state status signal configured to indicate a state of the latched output signal provided by the logic circuit; and a relay coil activation circuit configured to:

receive the state status signal provided by the relay contacts circuit; and provide the state status signal to a state-monitoring circuit of the process machine.

20. An apparatus, comprising:

a process machine having a pump-jack system;

a process-status switch being coupled to the pump-jack system; and a process-control element being coupled to the pump-jack system; and a sensor input signal conditioning circuit configured to provide a logic-converted status signal representing a process-status signal associated with the process-status switch being coupled to the pump-jack system of the process machine; and a logic circuit configured to provide a latched output signal converted from the logic-converted status signal provided by the sensor input signal conditioning circuit, and the latched output signal having any one of a first latched state and a second latched state; and a power output circuit configured to execute any one of maintaining and disconnecting a voltage being applied to the process-control element, in which the process-control element is coupled to the pump-jack system, depending on the state of the latched output signal; and wherein:

the process-control element includes an ignition coil for a gas powered motor; and the power output circuit is further configured to provide power to the ignition coil for the gas powered motor that is powering the pump-jack system of the process machine; and in response to the process-status switch, in which the process-status switch is coupled to the pump-jack system, being opened, the power output circuit is configured to de-energize the ignition coil which stalls the gas powered motor powering the pump-jack system of the process machine.

* * * * *